US006183060B1

(12) United States Patent
Tokuda

(10) Patent No.: US 6,183,060 B1
(45) Date of Patent: Feb. 6, 2001

(54) INK JET RECORDER

(75) Inventor: Hiroshi Tokuda, Anjou (JP)

(73) Assignee: Brother Kogyo Kabushiki Kaisha, Nagoya (JP)

( * ) Notice: Under 35 U.S.C. 154(b), the term of this patent shall be extended for 0 days.

(21) Appl. No.: 09/116,905

(22) Filed: Jul. 17, 1998

(30) Foreign Application Priority Data

Jul. 18, 1997 (JP) ..... 9-194529
Jul. 18, 1997 (JP) ..... 9-194531

(51) Int. Cl.[7] ..... B41J 2/165
(52) U.S. Cl. ..... 347/33; 347/29; 347/88
(58) Field of Search ..... 347/29, 33, 88, 347/30

(56) References Cited

U.S. PATENT DOCUMENTS

| | | | | |
|---|---|---|---|---|
| 4,533,927 | * | 8/1985 | Iwagami et al. | 347/29 |
| 5,138,343 | * | 8/1992 | Aichi et al. | 347/33 |
| 5,177,505 | | 1/1993 | Sugiura et al. . | |
| 5,223,860 | | 6/1993 | Loofbourow et al. . | |
| 5,639,220 | * | 6/1997 | Hayakawa | 417/53 |
| 5,831,644 | * | 11/1998 | Kato | 347/22 |
| 5,920,330 | * | 7/1999 | Ikezaki | 347/33 |

FOREIGN PATENT DOCUMENTS

| | | | | |
|---|---|---|---|---|
| 4-141439 | | 5/1992 | (JP) . | |
| 40564895 | * | 3/1993 | (JP) | 347/33 |
| 5-193152 | | 8/1993 | (JP) . | |
| 8-305325 | | 11/1996 | (JP) . | |
| 8-323999 | | 12/1996 | (JP) . | |
| 9-141898 | | 6/1997 | (JP) . | |

* cited by examiner

*Primary Examiner*—N. Le
*Assistant Examiner*—Shih-wen Hsieh
(74) *Attorney, Agent, or Firm*—Oliff & Berridge, PLC

(57) ABSTRACT

An ink-jet recording apparatus includes a head for ejecting ink and a carriage for conveying the head. When the cartridge has moved to a maintenance area and rotates a lever, the rotational force is transformed into a force for causing a pressing plate supporting a strip to move against the nozzle, by means of bevel gears, a pressing piece and a pivot arm. The strip comes in contact with the nozzle surface to wipe ink. The recording apparatus has a pump for applying a pressure to the interior of the head for purging the head and a conveyer for conveying the strip to refresh the part of the strip opposing the head. The pump and conveyer can be driven by a common motor which is also used for conveying the recording medium. The driving source used for the recording apparatus is shared thus making it possible to achieve a simplified configuration of the recording apparatus.

30 Claims, 18 Drawing Sheets

INK JET RECORDER

BACKGROUND OF THE INVENTION

1. Field of the Invention

The present invention relates to an ink-jet printer including a maintenance mechanism for keeping a good ejection condition of the ink-jet head, and more specifically relates to an ink-jet printer including a maintenance mechanism using strip-like cleaning paper for receiving ejected ink from the head and/or wiping the nozzle surface.

2. Description of the Related Art

Conventional ink-jet printers have an ink-jet head for ejecting ink, a carriage for moving the head along a recording medium in order to eject ink at a desired position of the recording medium, and a maintenance mechanism for keeping a good ejection condition of the ink-jet head.

For example, U.S. Pat. No. 5,177,505 corresponding to Japanese Patent Application Laid-Open No. 4-141,439 discloses a maintenance mechanism in which cleaning of an ink-jet head is performed by pressing the head against paper on a platen and frictionally sliding the head relative to the paper.

Japanese Patent Application Laid-Open No. 8-323,999 discloses a maintenance unit for an ink-jet printer using hot-melt type ink. This maintenance unit has an ink wiping mechanism wherein a strip of maintenance paper spooled out from a supply spool is put in contact with the head to thereby wipe ink.

Japanese Patent Application Laid-Open No. 9-141,898 (corresponding to U.S. patent application Ser. No. 08/751,768) discloses a cleaning device which, in order to remove dust and air remaining in the a nozzle of the ink-jet head, forces ink to eject out from the nozzle to thereby collect the dust etc., on cleaning paper disposed marginally spaced away from the nozzle. The ink-jet printer disclosed in Japanese Patent Application Laid-Open No. 9-141,898, comprises a pump which may apply either a positive back pressure or negative pressure to the ink-jet head, a conveyer having a strip of cleaning paper and conveying it to the head and a pushing means for pushing the cleaning paper against the head. However, an ink-jet printer of this type, was provided with a dedicated motor or solenoid as the driving source for the means of pushing the cleaning paper. Further, separate driving sources were used to drive the pump and the conveying means for the cleaning paper. In short, driving of the maintenance mechanism needed a multiple number of driving sources, resulting in a complicated configuration. Moreover, an ink-jet printer needs driving sources such as one as a feed motor for feeding print sheets and one for the carriage. Thus, an ink-jet printer needs a number of driving sources, resulting in a complex configuration and producing difficulties in reduction of the manufacturing cost.

SUMMARY OF THE INVENTION

A first object of the invention is to provide an ink-jet recording apparatus having a mechanism which can move the strip to be used for maintaining the head toward the head, without using a special actuator such a motor, solenoid or the like.

A second object of the invention is to provide a maintenance device which can drive a pump and a strip-conveyer used for maintaining the ink-jet head with a lower number of driving sources as well as to provide an ink-jet recording apparatus having the maintenance device.

In accordance with the first aspect of the invention, an ink-jet recording apparatus is provided which comprises:

a recording head having a nozzle for ejecting ink;

a carriage for conveying the recording head and moving across the width of the recording area opposing a recording medium and an additional area outside thereof;

a moving element which is disposed within the area outside the recording area and is capable of moving by being put in contact with the carriage or the head when the carriage has moved to the outside area;

a strip disposed within the outside area for cleaning the recording head with the surface thereof; and a support element for supporting the rearside of the strip, which can move toward the recording head to press the strip against the nozzle of the recording head, wherein the support element is caused to move toward the head by the driving force generated by the movement of the moving element, to thereby press the strip against the head.

In accordance with the ink-jet recording apparatus of the invention, when the carriage having the head therein has moved to the area outside the recording area, for example to the position opposing the strip in the maintenance area, the moving element, e.g., a rotational lever is pressed by the head or the carriage and moved. A force generated when the moving element is moved, for example, a rotational force can be used for the power source for causing the support element, e.g., a pressing plate, to move the strip toward the head. Accordingly, in the present invention, there no need to provide any dedicated actuator for moving the support element, thus simplifying the configuration of the maintenance mechanism, and hence reducing the manufacturing cost of the ink-jet printer.

In this document, it should be noted that cleaning of the recording head with a strip, includes not only wiping the ink adhering to the head by pressing the strip against the recording head, but also the cleaning of the ink channels and the nozzle by ejecting ink toward the strip.

The ink-jet recording apparatus may further comprise transmission elements for transmitting the force generated by the movement of the moving element to the support element. When the moving element is a rotational lever, the transmission elements may comprise: a first gear connected to the rotational lever; a second gear meshing with the first gear; a rotational element connected to the second gear; and a pivot arm urged by the rotational element so as to pivot. The pivot arm may be engaged with the support element. The pivot arm may comprise: an upper arm; a lower arm; a rotational shaft for rotatably supporting the lower arm with respect to the upper arm; and a spring urging the lower arm in the predetermined rotational direction with respect to the upper arm. The upper arm may have a pivot axle for the pivot arm, the lower arm may be engaged with the support element, and the lower arm may rotate with respect to the upper arm, opposing the urging force of the spring, when the support element has pressed the strip against the head.

Further, the ink-jet recording apparatus may further comprise: a damper for damping the impacts when the support element has pressed the strip against the head. The damper beneficially protects the head from impacts and can absorb the error and fluctuations occurring from the support element of the strip during manufacture and/or assembly. Therefore, it is possible to further enhance the durability of the head and the productivity of the ink-jet recording apparatus. The aforementioned lower arm and the spring may function as a damper for damping the impacts arising when the support element presses the strip against the head. Further, an elastic element may be provided on the support surface of the support element, to provide the functionality of a damper.

In accordance with the second aspect of the invention, an ink-jet recording apparatus is provided which comprises:

- a recording head having ink channels formed therein and a nozzle for ejecting ink;
- a pump which applies a pressure to the interior of the recording head to purge the ink channels and the nozzle;
- a strip used for cleaning the recording head;
- a conveyer for conveying the strip to thereby refresh the part of the strip opposing the nozzle; and
- a common driving source for driving the pump and the conveyer.

In the ink-jet recording apparatus in accordance with the second aspect thus configured, since the pump and the conveyer is driven by the common driving source, the number of the driving sources in the recording apparatus can be reduced to realize a very simplified configuration, and hence it is possible to reduce the manufacturing cost of the ink-jet recording apparatus.

The ink-jet recording apparatus of the second aspect may further comprise a carriage for conveying the recording head. The recording head may be provided with a hole which communicates with the ink channels and which can be connected to the pump. When the carriage has moved to the area outside the recording area, the hole may be covered by a cap communicating with the pump so that pressurized air may be supplied from the pump through the cap into the interior of the recording head, to thereby effect the purging. This application of pressurized air (positive pressure) can forcibly eject the ink together with dust and air bubbles from the ink channels and the interior of the nozzle. Since the strip is disposed opposite the head upon the ejection, the forcibly ejected ink can be beneficially received by the strip. As a method for forcing the ink to be ejected, a negative pressure may also be applied from the exit side (e.g. nozzle) of the ejection of ink path, but the method of applying a positive pressure is advantageous because the strip does not need to be removed from the front side of the head.

When the ink-jet recording apparatus comprises: a conveying roller for conveying the recording medium; and a motor for rotating the conveying roller, the motor may be used as a common driving source for driving the pump and the conveyer. This configuration enables the sharing of a driving source of the recording apparatus, thus making it possible to reduce the cost. In this case, the apparatus may further comprise: a planetary gear mechanism which can transmit the driving force from the motor to the pump and the conveyer only when the conveying roller is reversed. This configuration enables selective use of the driving force in accordance with the rotational direction of the conveying roller.

The pump may comprise: a pair of pistons each having an individual piston pin; a single cylinder, having an intake port and exhaust port, inside which the two pistons move; and a cam having a pair of eccentric annular grooves which are engaged with the two piston pins, respectively. The motor's driving force can be transmitted to the cam by way of a plurality of gears and a planetary gear mechanism. The conveyer may comprise: a feed roller for delivering the strip; and a shaft for taking up the strip. The driving force from the motor can be transmitted to the feed roller and the shaft for taking up the strip by way of a gear attached thereto or integrated therewith, another gear and a planetary gear mechanism.

When a positive pressure (back pressure) is applied from the pump and the ink ejected thereby is received by the strip, it is necessary to synchronize the operation of the pump with the conveyer. That is, since the ejected amount of ink varies in accordance with the amount of pressure from the pump, it is necessary to vary the conveyed length of the strip in accordance with the ejected amount in order to further enhance the reception of ink. In the present invention, since the pump and conveyer are driven by the common driving source, it is possible to drive them both in synchronism in a very simple manner. Accordingly, it is no longer necessary to independently control the driving timing and driven amount of them both.

In accordance with the third aspect of the invention, a maintenance device for an ink-jet recording apparatus having a recording head having ink channels formed therein and a nozzle for ejecting ink, is provided. This maintenance device comprises:

- a pump which is connected to the recording head and applies a pressure to the interior of the recording head to purge the ink channels and the nozzle;
- a strip used for cleaning the recording head;
- a conveyer for conveying the strip to thereby refresh a part of the strip opposing the nozzle; and
- a common driving source for driving the pump and the conveyer.

Since this maintenance device uses a single, common driving source for driving the pump and the conveyer, it is possible to simplify the configuration of the maintenance device as well as that of the ink-jet recording apparatus to which the maintenance device is applied, thus making it possible to reduce the manufacturing cost.

DESCRIPTION OF THE PREFERRED EMBODIMENTS OF THE INVENTION

Figure 1:
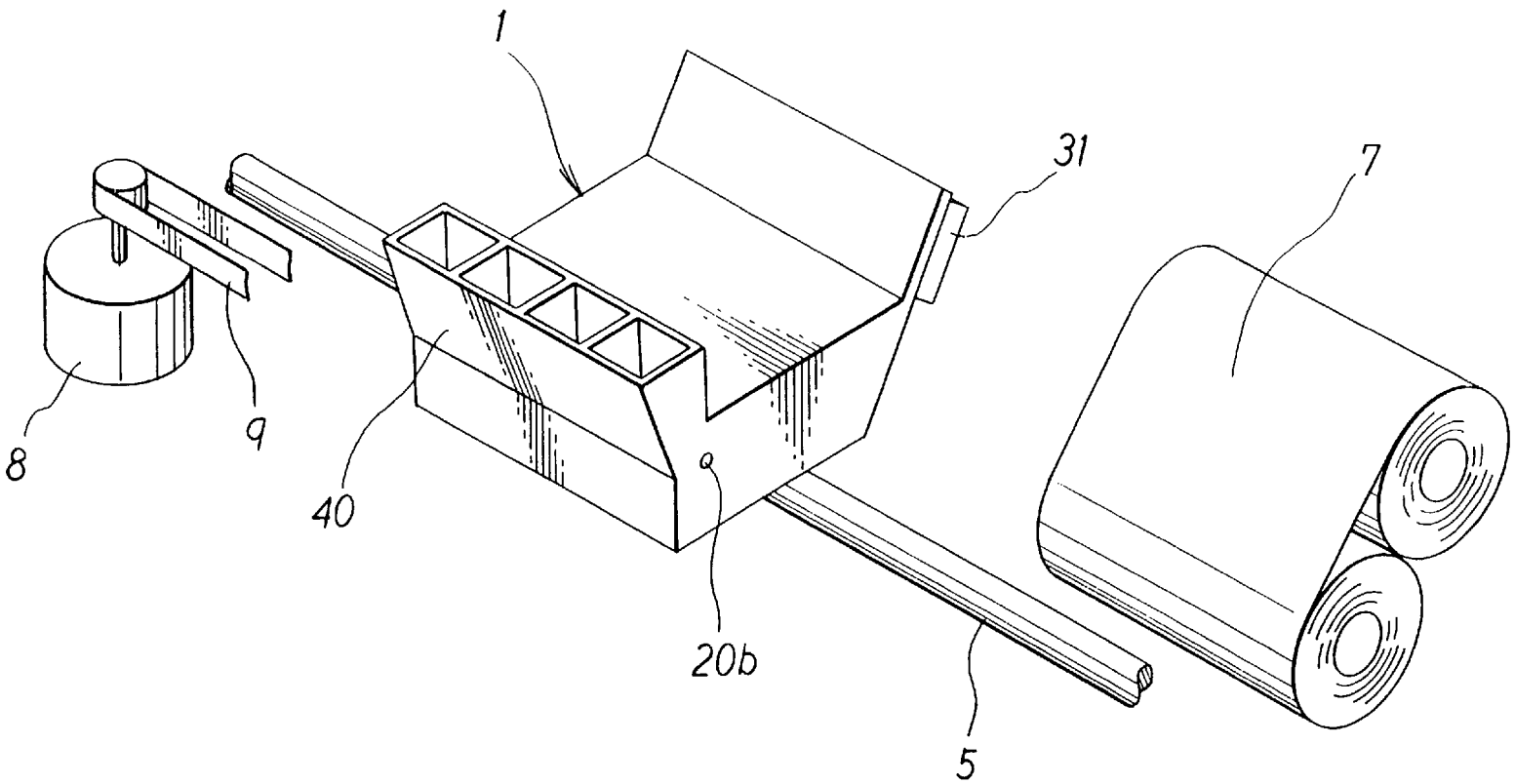
FIG. 1 is an overall view showing the essential configuration of an ink-jet printer in accordance with the present invention.

Next, the embodiment of the present invention will be described with reference to the accompanying drawings. FIG. 1 is an overall view showing the essential configuration of an ink-jet printer to which the present invention is applied. The ink-jet printer of this embodiment is a so-called hot-melt ink-jet printer, which uses ink of a solid type and ejects the melted ink. A printer of this type is disclosed in Japanese Patent Application Laid-open No. 5-193,152, which corresponds to U.S. Pat. No. 5,223,860 and is also disclosed in Japanese Patent Application Laid-Open No. 8-323,999, the disclosures of which are incorporated as a part herein by reference. The assignee of this application has disclosed a head structure for use in a hot-melt ink-jet printer in Japanese Patent Application Laid-Open No. 8-305,325.

As shown in FIG. 1, a head 1 of the present ink-jet printer is mounted in a carriage 3 (FIG. 8) so as to be movable along a guide shaft 5. The head 1 forms an image by ejection of ink onto a recording sheet of paper (not shown) as a recording medium, conveyed in the central area in the movable area thereof, and moves to a maintenance area in the vicinity of the left end (the left side in FIG. 1) of the guide shaft 5 before and after the image formation or at predetermined timing, whereby the head undergoes a maintenance treatment with a roll of paper 7. Here, the carriage 3 has a well-known configuration, which is connected to a motor 8 as the head shifting device through a belt 9, so as to move along the guide shaft 5 in accordance with the rotation of the motor 8.

Figure 2:
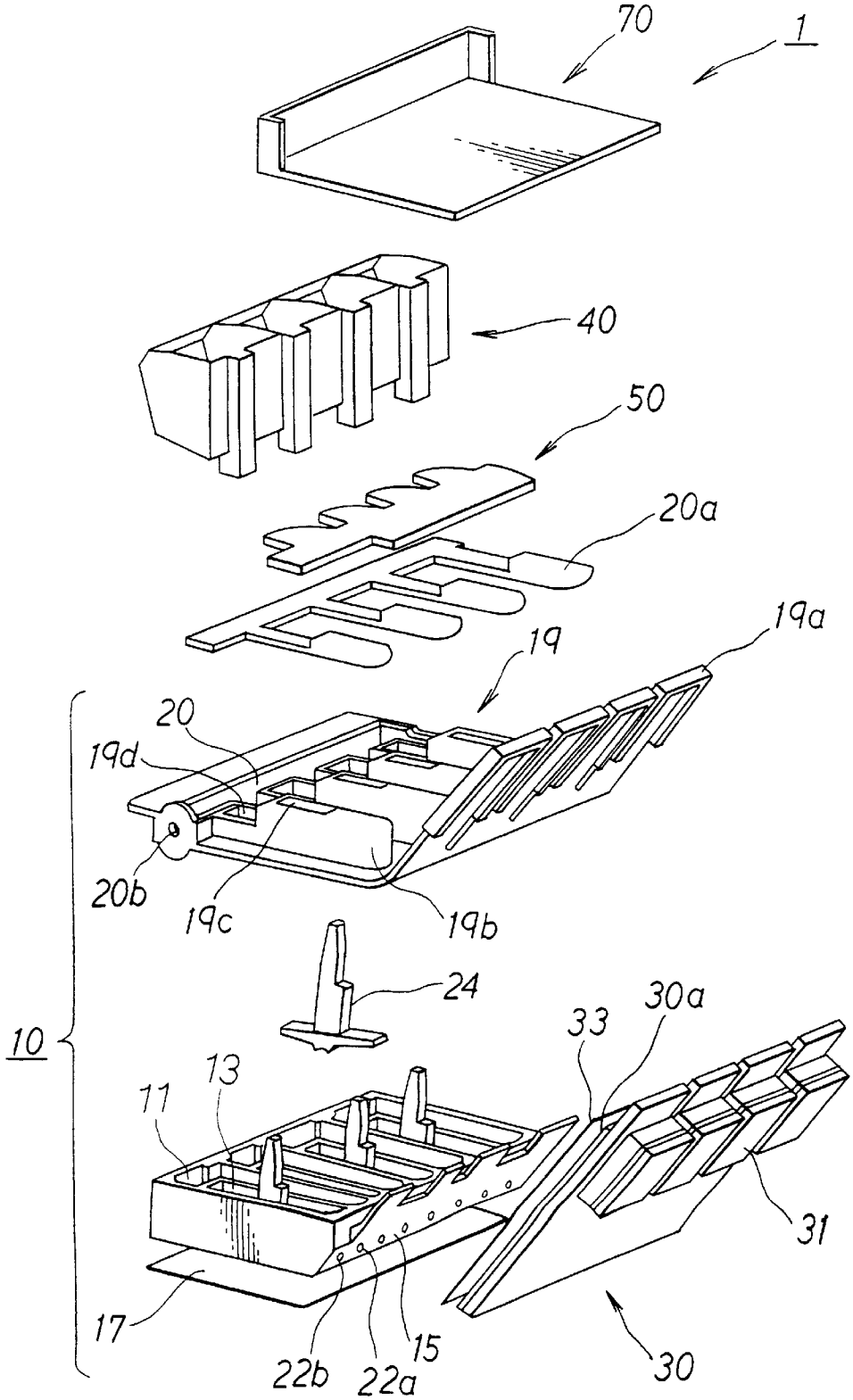
FIG. 2 is an exploded perspective view showing the configuration of the head of an ink-jet printer.
Figure 3:
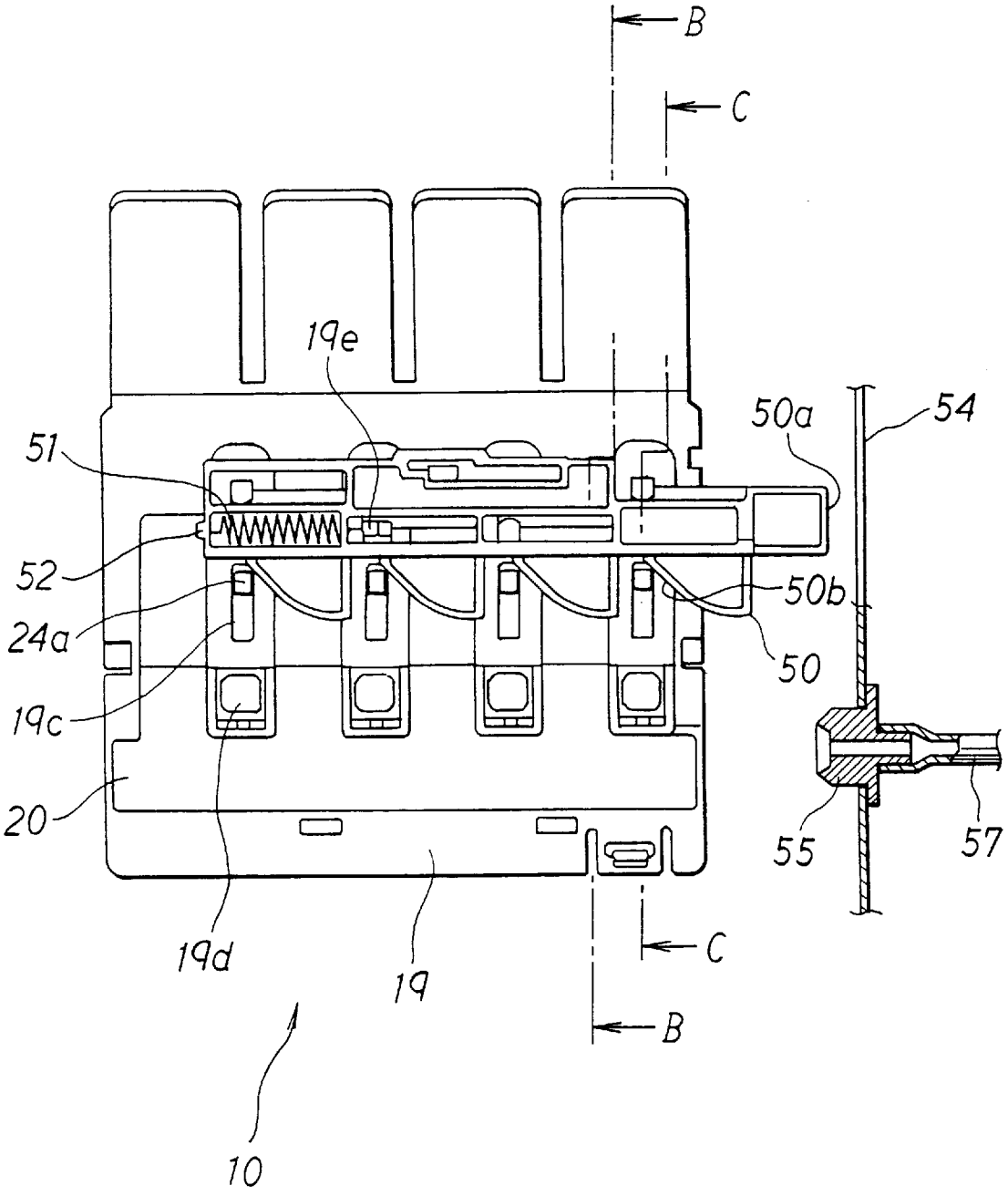
FIG. 3 is a top view showing the configuration of the ink tank of the head shown in FIG. 2.
Figure 4A:
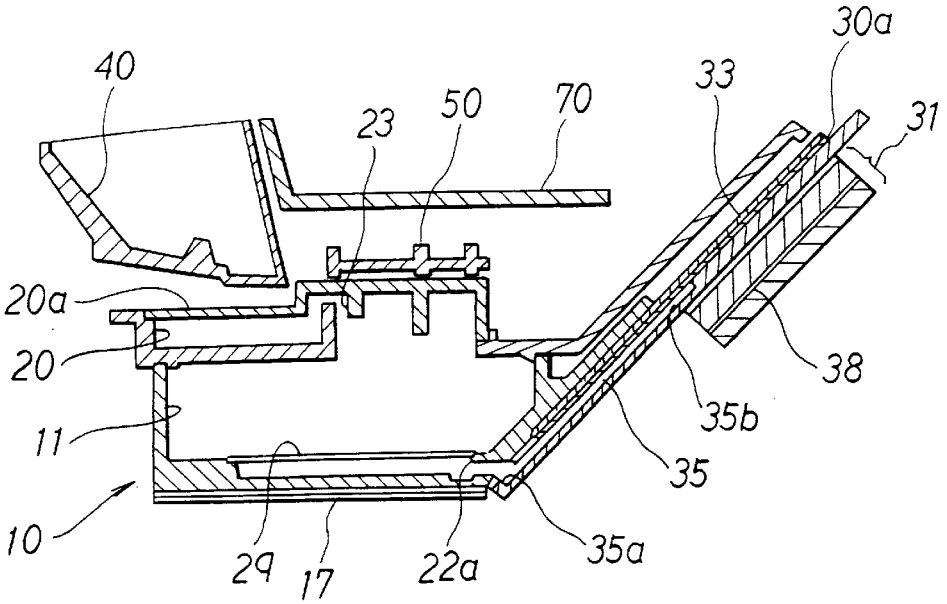
FIGS. 4A and 4B are sectional views cut across lines B—B and C—C, respectively for illustrating the configuration of the ink tank shown in FIG. 3.
Figure 4B:
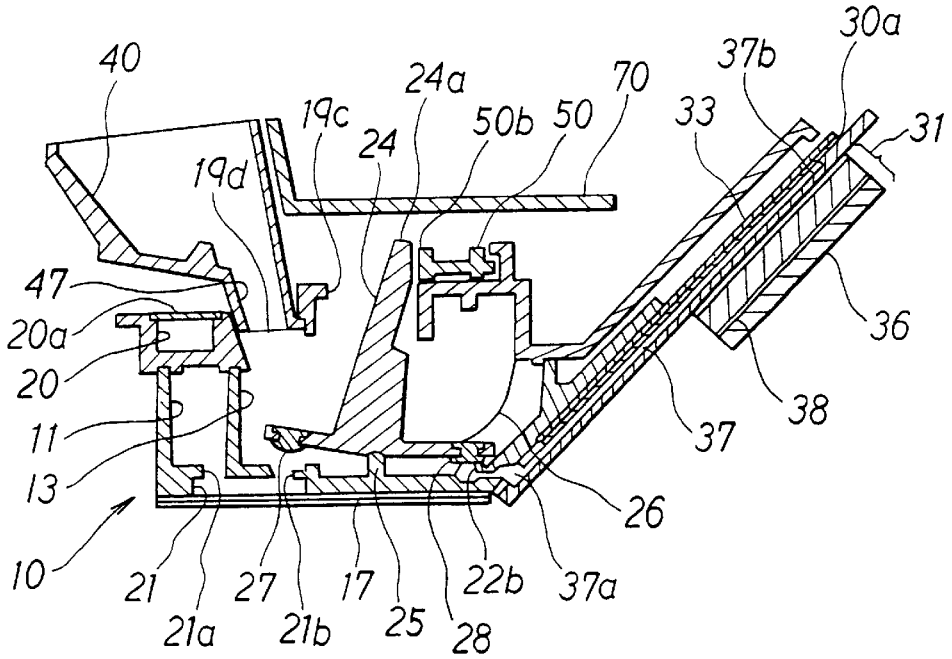

Next, the configuration of the head 1 will be described with reference to FIGS. 2 to 4. FIG. 2 is an exploded perspective view of the head 1, FIG. 3 is a top view of an ink tank 10 of the head 1, and FIGS. 4A and 4B are sectional views cut across lines B—B and C—C in FIG. 3. The configuration of the head 1 is described in detail in Japanese Patent Application No. 8-305,325.

The head 1, as shown in FIG. 2, comprises the ink tank 10, a front panel 30, a melting tank 40, a cam 50 and a control board stage 70. The ink tank 10 includes a front portion 15 which is inclined to have the front panel 30 attached thereto, four sets of main chambers 11 and sub-chambers 13 for holding four colors of hot melted ink (which may be also referred to simply as ink) for color output (yellow, magenta, cyan and black), an ink tank top cover 19, and an ink tank heater 17 attached to the undersurface of the ink tank 10. Further, as shown in FIG. 4B, each set of main chambers 11 and sub-chambers 13 in the ink tank 10 has a commutation passage 21 which opens downward, at the bottom on the rear side of the ink tank 10.

The main chamber 11 has an L-shape configuration when viewed from the top as shown in FIG. 2, and has a main chamber inlet 21*a* (FIG. 4B) that is connected to the communication passage 21, a main chamber outlet 22*a* (FIG. 4A and FIG. 2) that is connected to the front panel 30, and a filter 29 (FIG. 4A). The filter 29 is one produced by sintering fibers of stainless steel into a sheet-like form, and then pressing it so that fibers are complexly bent and overlapped forming channels of a spatial structure (for example "Tommyfilec SS" (trade name): (stainless steel sintered sheet) a product of Tomoegawa Paper Co., Ltd.).

The sub-chamber 13 comprises a sub-chamber outlet 21*b* connected to the communication passage 21, a sub-chamber inlet 22*b* communicating with the front panel 30, and as shown in FIGS. 2 and 4B, an approximately inverted T-shaped valve control lever 24 for opening either sub-chamber outlet 21*b* or sub-chamber inlet 22*b* while closing the other.

The valve control lever 24 is die-cast from aluminum alloy, and as shown in FIG. 4B, is mounted so that it can be supported pivotally at a lever seat 25 provided between the sub-chamber outlet 21*b* and sub-chamber inlet 22*b*. The valve control lever 24 has pressure valves 27 and 28. In this arrangement, the lever 24 is urged by a leaf spring 26 under normal conditions so that the pressure valve 28 seals the sub-chamber inlet 22*b*. Here, the pressure surface of the pressure valve 27 is of a spherical form while the socket rim of sub-chamber outlet 21*b* corresponding to the valve 27 is tapered. The pressure surface of the pressure valve 28 is flat while the socket rim of the sub-chamber inlet 22*b* corresponding to the valve 28 is of an annular projected form. The pressure valves 27 and 28 are made from silicone rubber having a Shore hardness of about 40° with a heat-resistance temperature of about 200° C.

The ink tank top cover 19 has, as shown in FIG. 2, a front panel cover portion 19*a* which fits the shape of the front panel 30, a sub-chamber cover portion 19*b* for covering sub-chambers 13, slots 19*c* for exposing upper ends 24*a* of valve control levers 24, ink charging ports 19*d* through which hot-melt ink is supplied from the melt tank 40 to the sub-chamber 13, an air chamber 20 for sending compressed air from an aftermentioned pump 160 to each main chamber 11, a passage hole 20*b* on the side wall penetrating from the air chamber 20 to the side surface of the ink tank 10, and an air chamber lid 20*a* for sealing the air chamber 20. Here, the air chamber 20 of the ink tank top cover 19 has a passage hole 23 which is connected to each main chamber 11, as shown in FIG. 4A.

The front panel 30, as shown in FIG. 2, has four nozzle heads 31 on the front side thereof, and the rear side of the front panel 30 is provided with outward channels 35 (FIG. 4A) which each establish the commutation between a corresponding main chamber 11 and nozzle head 31, and inward channels 37 (FIG. 4B) which each establish the commutation between a corresponding nozzle head 31 and sub-chamber 13. Further, as shown in FIG. 2 and FIGS. 4A and 4B, a cover panel 30*a* is provided on the rear side of the front panel 30 so as to cover the outward and inward channels 35 and 37. Further, a front panel heater 33 is attached to the rear side of this cover panel 30*a*. As shown in FIG. 4, provided at the joint from each main chamber 11 to the corresponding outward channel 35 is an outward entrance 35*a* while an outward exit 35*b* is provided at the joint from the outward channel 35 to the corresponding nozzle head 31. Further, an inward entrance 37*b* is provided at the joint from each nozzle head 31 to the corresponding inward channel 37 while an inward exit 37*a* is provided at the joint from the inward channel 37 to the corresponding sub-chamber 13.

The nozzle head 31 has a piezoelectric crystal-element 38, and ejects ink supplied through the outward exit 35*b*, in accordance with the change in the volume of the piezoelectric crystal-element 38. Further, ink supplied to the nozzle head 31 can be circulated to the sub-chamber 13 by way of the inward entrance 37*b* and the inward channel 37.

The cam 50 is attached over the ink tank top cover 19 so that it can slidably move in the left and right directions in FIG. 3, with the portion around an abutment face 50*a* projected to the right from the boundary of the ink tank top cover 19. The cam 50 has four cam surfaces 50*b*, and is urged by a spring 51 which is tensioned between a projection 52 provided at the left end of the cam 50 and a projection 19*e* provided in the ink tank top cover 19, so that the cam surfaces 50*b* are kept out of contact with the upper ends 24*a* of valve control levers 24, under normal conditions.

The melt tank 40 is partitioned into four compartments for black, cyan, magenta and yellow, as shown in FIG. 2. Each compartment is provided in a box-like form with a top opening so as to be charged with solid ink. Provided the lower part of the each compartment of the melt tank 40 is a conduit 47 for leading the molten ink to the sub-chamber 13.

The melt tank 40 is changed with solid ink by means of an unillustrated ink charger. The melt tank 40 has a heater, which melts the solid ink so that the ink can be supplied to the sub-chamber 13 of the ink tank 10 through the conduit 47. Further, the control board stage 70 has an unillustrated control board, and is attached to the upper part of the head 1.

Figure 14:
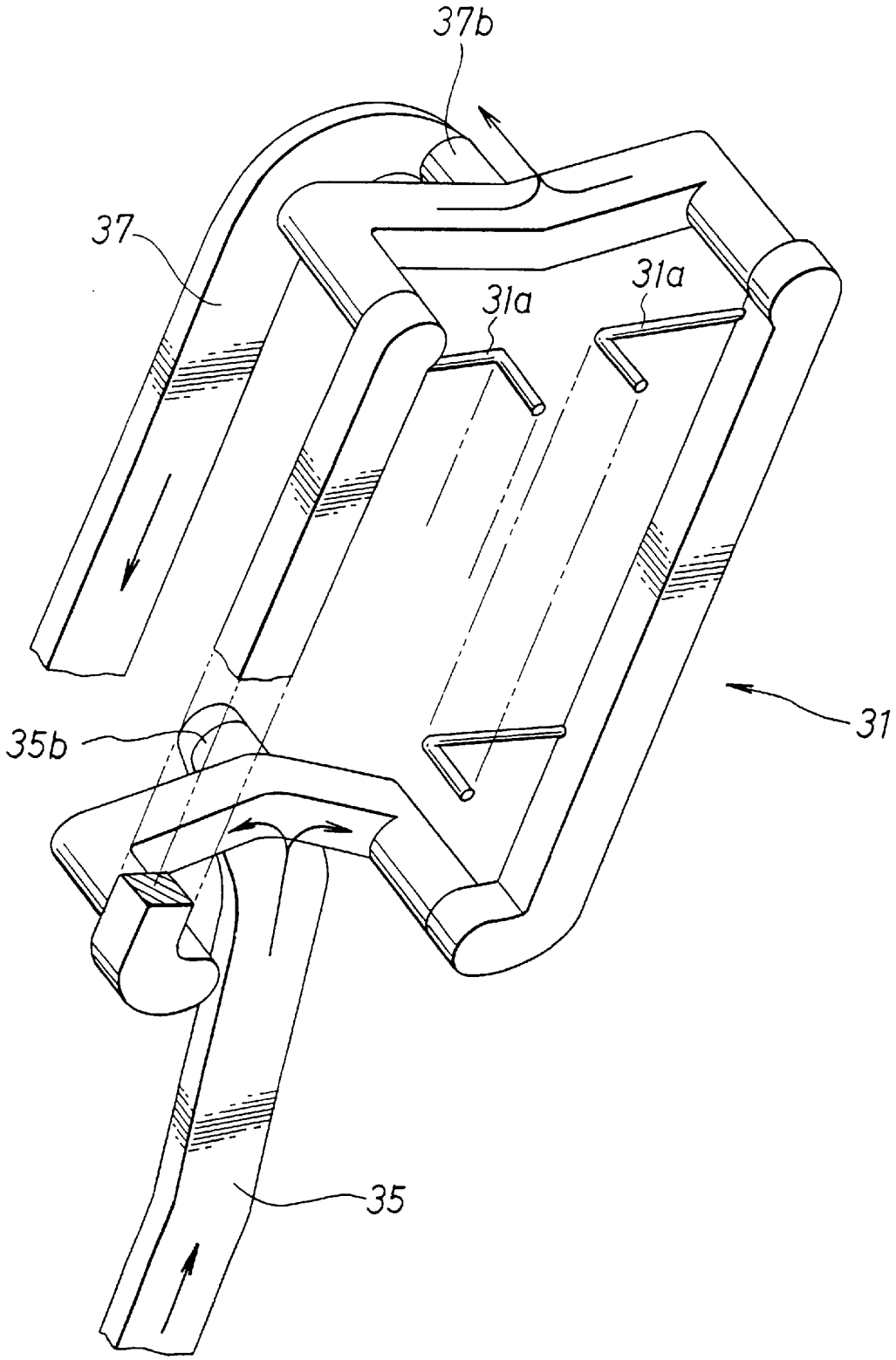
FIG. 14 is an illustrative view showing the structure of flow channels of a nozzle head.

In the head 1 thus configured, the control board stage 70 drives the heaters 17, 33 etc. so as to keep the solid ink in a molten state so that ink is ejected by driving the piezoelectric crystal-element 38 in accordance with the print data etc., as already mentioned. When the ink head 1 has moved to the aforementioned maintenance area, a purging operation is performed in the following manner. Purging is an operation of pressurizing the ink inside the front panel 30 and the nozzle head 31 from the main chamber side 11 to displace the ink with air bubbles and dust, which will cause malejection. More specifically, those within the nozzle portion (designated at 31*a* in FIG. 14) are displaced outside from the nozzle together with the ink while those inside the front panel 30 are pushed into the sub-chamber 13, to thereby fill each space with clean ink which has been filtered by the filter 29. Contamination of the ink with air bubbles occurs when ink, which was once molten ink but has solidified due to reduction in head temperature after the power has been deactivated, again melts upon re-activation of the power. As to dust, it may enter from the nozzle.

Once the head 1 has moved to the maintenance area, the abutment face 50*a* of the cam 50 is pushed against a frame 54 of the printer body (see FIG. 3) while a hollow, cylindrical cap 55 formed in the frame 54 covers the passage hole 20*b*. Then, the cam 50 relatively slides to the left over the ink tank top cover 19, the cam surfaces 50*b* push respective upper ends 24*a* of valve control levers 24, in the downwards direction in FIG. 3. Accordingly, each valve control lever 24 sways pivotally at the lever seat 25, so as to release the pressure contact between the pressure valve 28 and the sub-chamber inlet 22*b* whilst a further sway establishes a pressure contact between the pressure valve 27 and sub-chamber outlet 21*b*, whereby the sub-chamber inlet 22*b* is opened while the sub-chamber outlet 21*b* is sealed.

At this moment, since the cap 55 has covered passage hole 20*b*, compressed air is sent from an aftermentioned pump 160 via a pipe 57 which is connected to the hollow of the cap 55 so as to push out air bubbles as described below. The sending of compressed air increases the pressure inside the main chamber 11. Since the sub-chamber outlet 21*b* is sealed, a positive back pressure is applied to the ejection ink path from the main chamber 11 to the nozzle head 31 via outward channel 35. On the other hand, since the sub-chamber inlet 22*b* is open, the ink containing air bubbles from the main chamber 11 is filtered of air bubbles and dust by the filter 29, to reach the nozzle head 31 passing through main chamber outlet 22*a*, the outward entrance 35*a*, the outward channel 35 and the outward exit 35*b*. Then, the flow of the ink branches into two paths, i.e., one which is discharged (ejected) to the outside from the nozzle portion 31*a* and the other which is directed to the inward entrance 37*b* side. The flow ratio between the two is determined depending upon the settings of the flow resistance of the outward channel 35, inward channel 37 and nozzle portion 31*a*. The ink of the path on the inward entrance 37*b* side is sent to the sub-chamber 13 by way of inward channel 37, inward exit 37*a* and sub-chamber inlet 22*b*. Thus, the ink containing air bubbles inside the outward channel 35, nozzle portion 31*a* and inward channel 37 is replaced by clean ink.

Thereafter, the head 1 is moved to the left so as to set the abutment face 50*a* away from the frame 54, whereby the upper ends 24*a* of the valve control levers 24 are released from being pressed by cam surfaces 50*b*. At this moment, each valve control lever 24 is moved pivotally at the lever seat 25 by the urging force of the leaf spring 26, whereby the sub-chamber inlet 22*b* is sealed while the sub-chamber outlet 21*b* is opened. Thereby, the ink which has been forced to enter the sub-chamber 13 through purging is fed back to the main chamber 11 from the communication passage 21 so that the level of the liquid surface in the main chamber 11 can be equalized with that in the sub-chamber 13.

Figure 5:
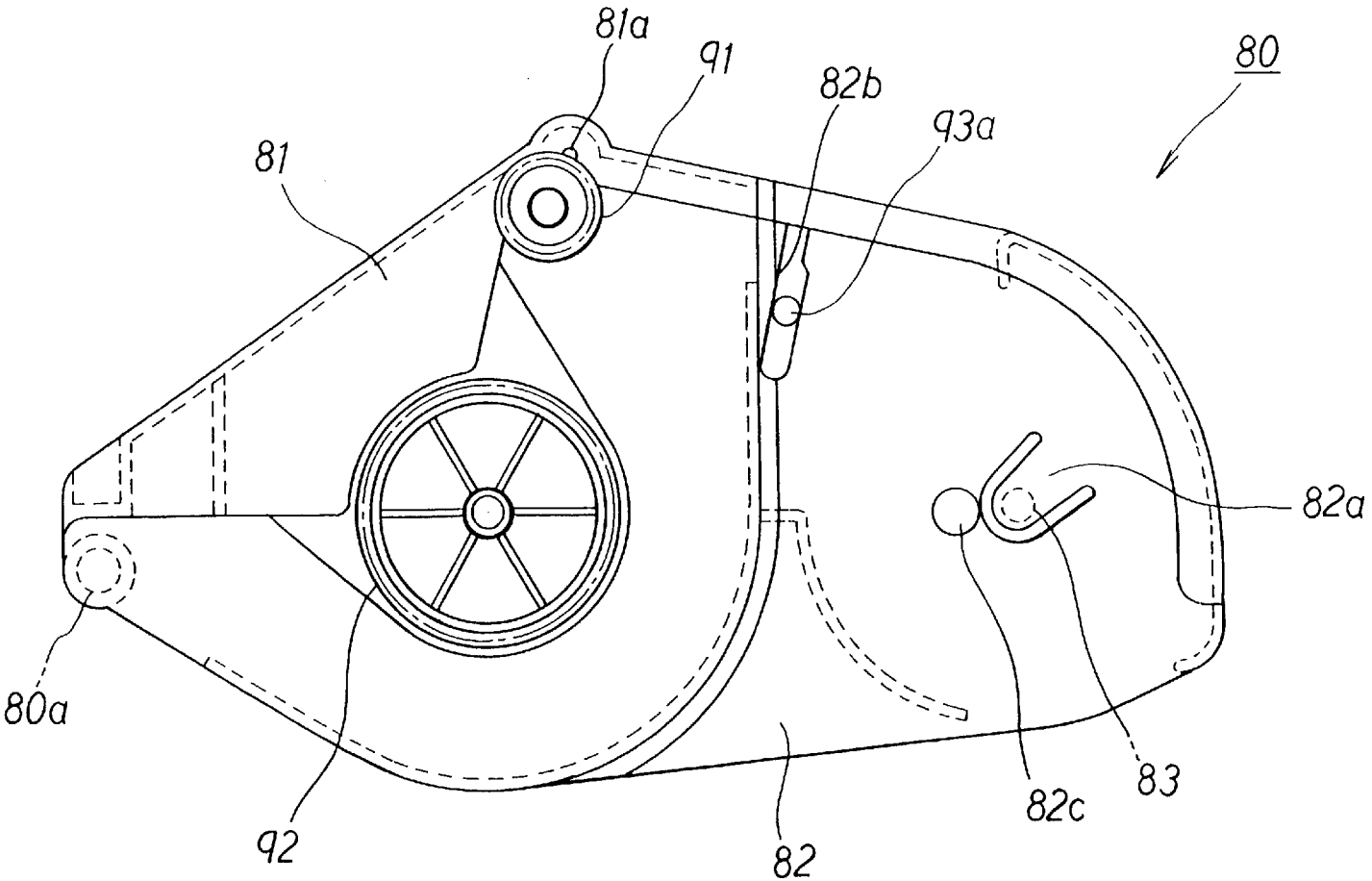
FIG. 5 is a left-side view showing the configuration of a cassette for head maintenance used in the ink-jet printer in accordance with an embodiment.

When the aforementioned purging is performed, part of the ink is forced to be ejected from the nozzle surface 36 of the nozzle head 31. In the present ink-jet printer, since the roll of paper 7 is disposed in the maintenance area, the nozzle surface 36 is wiped by this roll of paper 7 whilst receiving the ejected ink. Next, the configuration of a maintenance unit 100 which feeds the roll of paper 7 and presses it against the nozzle head 31, i.e., the function of the maintenance mechanism, will be described. In the beginning, since the roll of paper 7 is a consumable item, it is held by a cassette 80 shown in FIGS. 5 and 6, and either the whole the cassette 80 or only the roll of paper 7 is replaced when it is used up. Distribution to the user is done either as the cassette 80 or by a set of the rolls of paper 7 for refill, which can be selected at the user's convenience. FIG. 5 is a left-side view showing the configuration of the cassette 80, and FIG. 6 is a vertical sectional view of FIG. 5.

Figure 6:
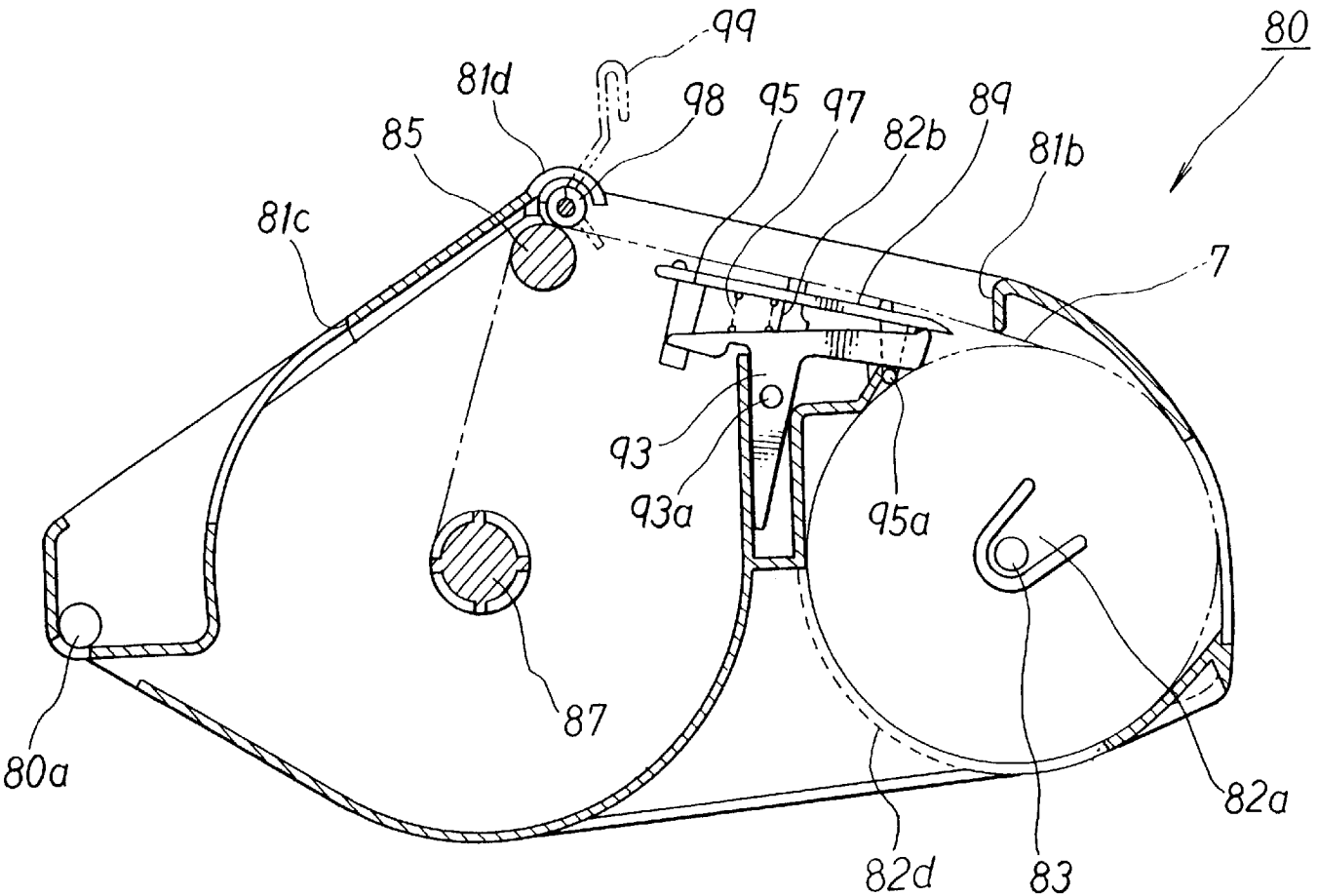
FIG. 6 is a vertical sectional view showing the configuration of the cassette shown in FIG. 5.

As shown in FIGS. 5 and 6, the cassette 80 is composed of a casing 82 and a cover 81 which can be pivoted at a hinge 80*a* in an openable and closable manner. Provided inside the casing 82 are a pin 83 set on the inner wall surface for supporting an unused roll of paper 7, a fixed-rate feed roller 85 for feeding the paper from the roll of paper 7, a winding shaft 87 for taking up the fed paper from the roll of paper 7 and a pressing plate 89 for pressing a stretch of paper 7 against the nozzle head 31. The side wall of the casing 82 in which the pin 83 is formed has an approximately U-shaped cutout to form an sectioned piece 82*a*. This piece 82*a* can easily flex to the exterior from the casing side wall, owing to its elasticity. Accordingly, the pin 83 can be displaced outward when a roll of paper 7 is mounted and then case revert itself back to the original position due to its elasticity and fit into the paper core of the roll of paper 7, thus the roll of paper 7 is supported by the pin 83. The rotary shaft of the fixed-rate feed roller 85 and the winding shaft 87 are projected on the both left and right sides, with gears 91 and 92 fixed respectively on the outside of the left face of the casing 82.

Further, as shown in FIG. 5, formed on either side wall of the casing 82 is a slot 82*b* which is approximately perpendicular to the conveying path of the strip of paper 7 from the circumference of the pin 83 to the fixed-rate feed roller 85. Fitted into the slots 82*b* is a pin 93*a* which is formed in a support 93 of the pressing plate 89. The pressing plate 89 comprises this support 93, a plate 95 connected to the support 93, pivotally by a pair of pins 95*a*, a compression coil spring 97 urging the plate 95 further away from the support 93. Projected on either side of the casing 82*c* is a guide pin 82*c* as shown in FIG. 5.

A nip roller 98 is provided inside the cover 81 mounted in elliptical holes 81*a* formed in the cover 81. This nip roller 98 receives the pressure from a leaf spring 99 provided for the upper frame of the printer body and is pressed against the fixed-rate feed roller 85 to nip the strip of paper 7 therebetween. Further, formed in the upper part of the cover 81 (in the upper portion in FIGS. 5 and 6) is an opening 81*b* for allowing the strip of paper 7 to be projected outside and an opening 81*c* for allowing the detection of the quantity of the wound roll of paper 7 on the winding shaft 87, while an opening 82*d* for allowing an aftermentioned sensor 110 to detect the presence of the roll of paper 7 remaining on the pin 83 side is provided in the lower part of the casing 82. There also, formed on the boundary of the opening 81*b*, is a notch 81*d* for allowing the leaf spring 99 to pass therethrough.

Figure 17:
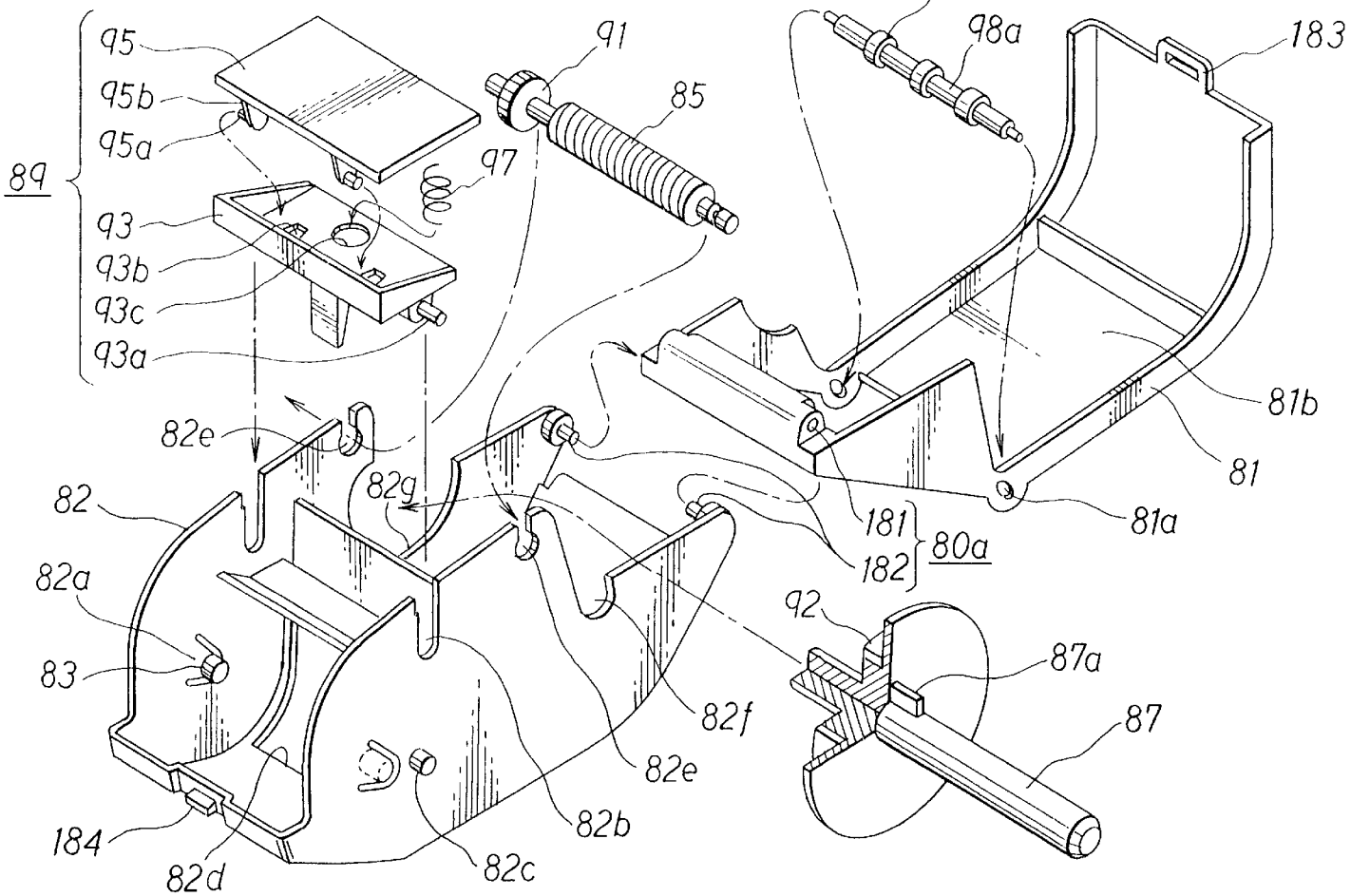
FIG. 17 is an exploded perspective view showing the cassette shown in FIGS. 5 and 6.

Referring to FIG. 17, the cassette 80 will be described in further detail. FIG. 17 is an exploded perspective view showing the cassette 80 shown in FIGS. 5 and 6, with the cover 81, the pressing plate 89, etc., removed from the cassette casing 82. The cassette 80 is assembled, as mentioned above, of the cover 81, casing 82, fixed-rate feed roller 85, winding shaft 87, support 93, plate 95, compression coil spring 97 and nip roller 98. Here, all the parts except the compression coil spring 97 are molded from synthetic resins. As examples of synthetic resin for these parts, PS (polystyrene) is used for the cover 81 and casing 82, ABS is used for the winding shaft 87, PC (polycarbonate) is used for the support 93 and plate 95, POM (polyoxymethylene) is used for the nip roller 98. Formed over the periphery of the fixed-rate feed roller 85 is an elastic layer composed of sponge, rubber or the like. These parts can be configured so as to be disassembled into individual parts as shown in FIG. 15, without using any tools.

Illustratively, formed on the left and right at the rear end of the cover 81 are round bores 181 while cylindrical pins 182 projected from the left and right inner walls are formed at the rear end of the casing 82. The side walls of casing 82 are elastically deformed at their rear end so that the pins 182 set on both sides fit into respective round bores 181, forming the hinge 80*a*. In this way, the cover 81 can be connected to the casing 82 in an openable and closable manner. The cover 81 has an rectangular hole 183 at its front end while the casing has a projection 184 at its front end. As the cover 81 is closed with respect to the casing 82, the part with the rectangular hole 183 is once elasticity deformed outward and then reverts back to thereby become engaged with the projection 184. This engagement keeps the cover 81 from being opened by any naturally arising external force.

The pins 95*a* of the pressing plate 89 are formed on a pair of support tabs 95*b* projected from the undersurface of the plate 95. When these support tabs 95*b* are elastically deformed inward and the pins 95*a* are inserted into a pair of rectangular holes 93*b* provided in the support 93 and revert back, the tabs 95 are connected to the support 93, pivotally on pins 95*a*. In this arrangement, the compression coil spring 97 is inserted to a hollow 93*c* formed on the upper surface of the support 93, to complete the pressing plate 89. Each slot 82*b* in the casing 82 opens, but becomes narrowed, at the upper edge of casing 82. This configuration allows the pressing plate 89 to be attached to the casing 82 by squeezing the pins 93*a* of the support 93 down into the slots 82*b*.

The fixed-rate feed roller 85 is formed integrally and coaxially with the gear 91 and is supported rotatably by a pair of bearing holes 82*e* provided in the casing 82. Each bearing hole 82*e* opens, but becomes narrowed, at the upper edge of the casing 82, so as to allow the fixed-rate feed roller 85 with gear 91 to be attached to the casing 82 by squeezing the shaft of the fixed-rate feed roller 85 down into the bearing holes 82*e*. The winding shaft 87 is formed integrally and coaxially with the gear 92 and is mounted from above into bearing holes 82*f* and 82*g* which are formed in casing 82. Thereafter, when the cover 81 is closed, the winding shaft 87 with gear 92 is held between bearing hole 82*f*, 82 and lower edge of the cover 81 so that it can be supported rotatably. Further, the nip roller 98 has a flexible shaft 98*a*. This shaft 98*a* is deformed so that both ends can be inserted into elliptical holes 81*a* from the inner sides to thereby attach nip roller 98 to the cover 81.

In this way, the cassette 80 of this embodiment can be easily assembled from, and disassembled into, individual parts without using any tools. Accordingly, when the roll of paper 7 has been used up from the maintenance operation, it is possible to easily reuse the cassette 80 by refilling with a roll of paper 7 in the following manner.

Figure 7:
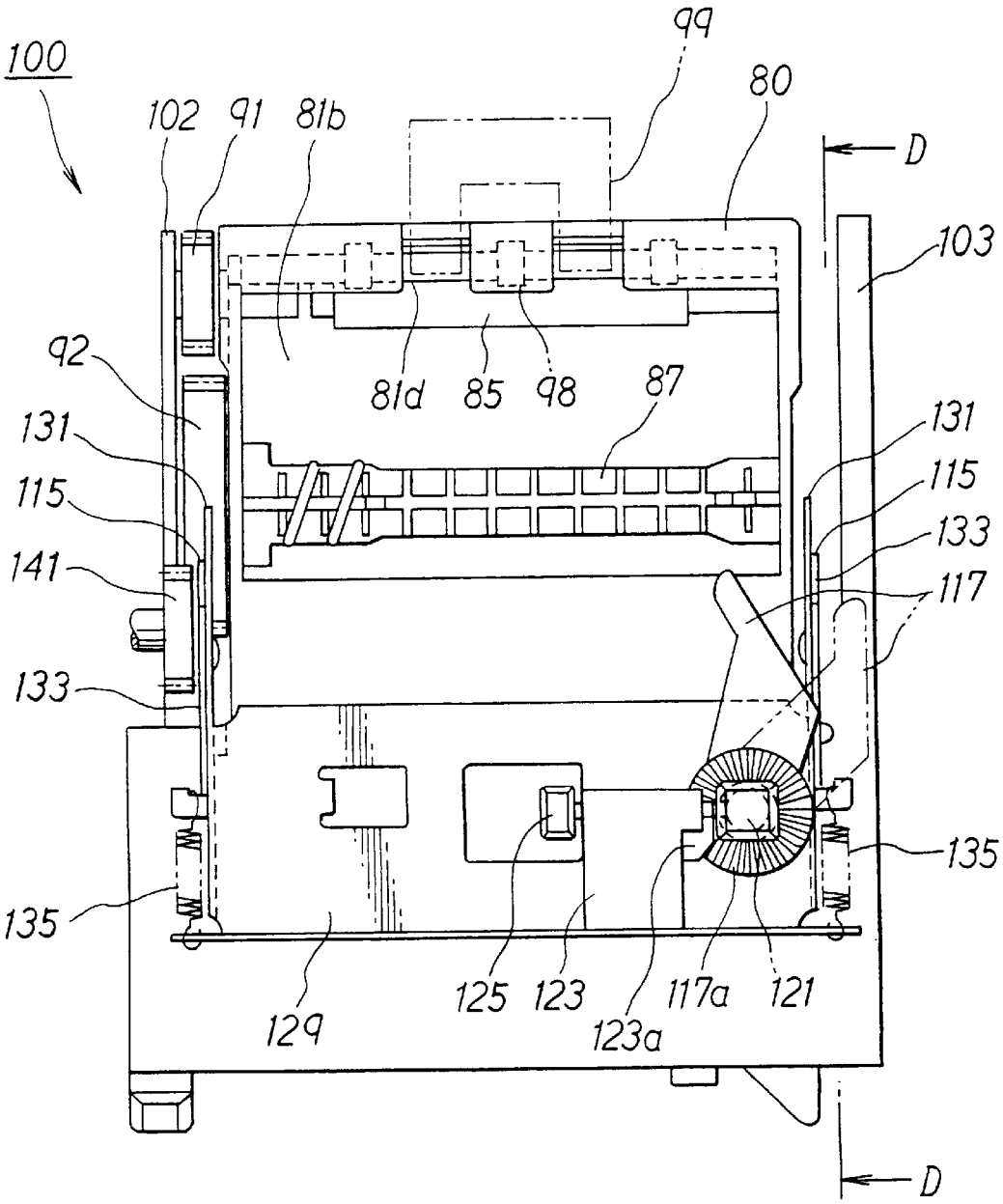
FIG. 7 is a front view showing the configuration of a maintenance unit when the cassette is mounted.
Figure 8:
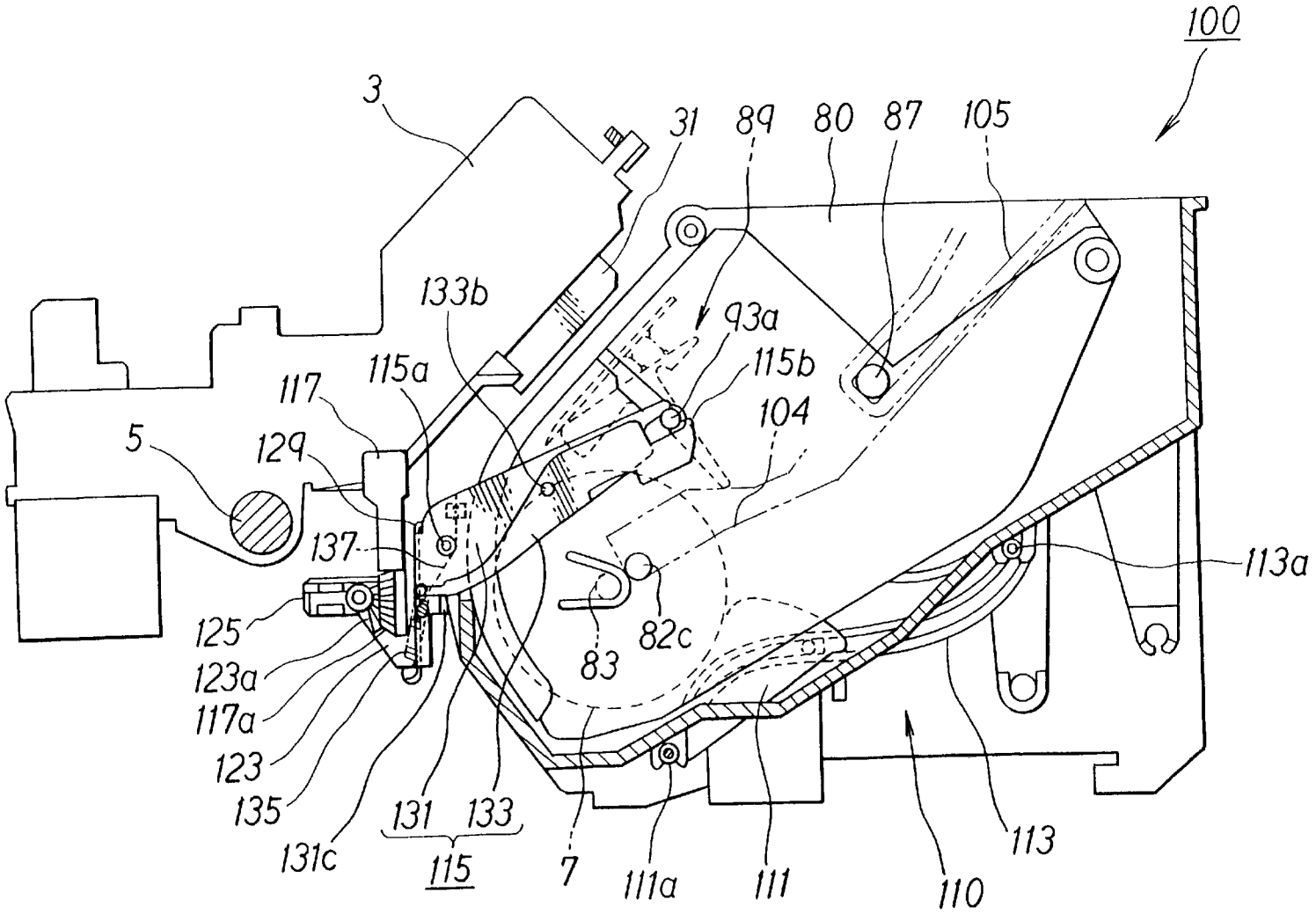
FIG. 8 is a sectional view cut across a line D—D showing the maintenance unit shown in FIG. 7.
Figure 9:
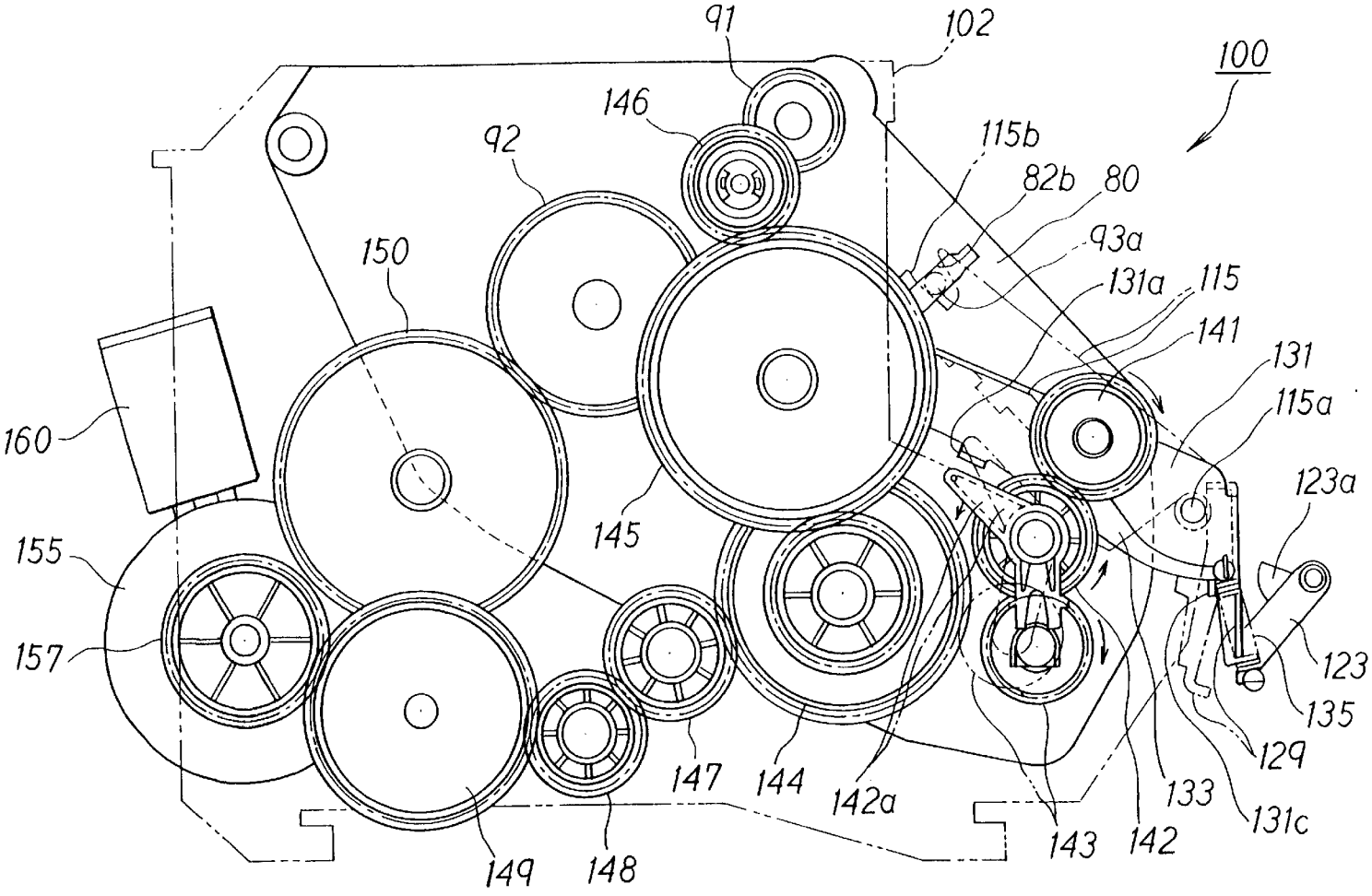
FIG. 9 is a left-side view showing the maintenance unit shown in FIG. 7.

Referring next to FIGS. 7 through 9, description will be made of the configuration of the maintenance unit 100 when the cassette 80 has been set. For simplifying the illustrations, the pressing plate 89 is omitted in FIG. 7, and the side frame 102 is depicted with dashed line in FIG. 9. As shown in FIGS. 7 and 8, the maintenance unit 100 has a pair of side frames 102 and 103. Each side frame 102 and 103 has guides 104 and 105, guiding the pin 82*c* and the winding shaft 87, respectively (FIG. 8). When the cassette 80 is mounted along the guides 104 and 105, movable parts 111 and 113 of the sensor 110 disposed below those guides pivot about shafts 111*a* and 113*a*, respectively. When the cassette 80 is completely set in, the movable part 111, on the carriage 3 side, is held inside the cassette 80 by the pin 83 while abutting the roll of paper 7. This sensor 110 detects the presence or absence of the roll of paper 7 based on the deflected state of the movable part 111.

Both ends of the pin 93*a* of the pressing plate 89 are projected from both sides of the cassette 80, and are engaged with the distal ends of a pair of arms 115 which can pivot about a point in the front side (the side opposing the carriage 3: the positional relationship of the cassette 80, i.e., the front and rear sides thereof, will be referred to hereinbelow in the same manner) of the maintenance unit 100. Provided at a further front position of the maintenance unit 100 is a lever 117 which pivotally moves when the carriage 3 abuts it. With the sway of this lever 117, the pressing plate 89 is projected in the following way.

As shown in FIG. 7, the lever 117 is disposed pivotally about an axle 121 which projects towards the front of the maintenance unit 100. When the carriage 3 is moved to the aforementioned maintenance area, the lever 117 is pushed by the carriage 3 and rotated clockwise up to a position indicated by the two-dot chain line in FIG. 7. The lever 117 has an integrated bevel gear 117*a* supported about the axle 121. This bevel gear 117*a* meshes another bevel gear 123*a* which is integrated with a pressing piece 123. This pressing piece 123 is installed rotatably between the distal end of the axle 121 and the distal end of an axle 125 which is projected in parallel with the axle 121. Therefore, with the above movement of the lever 117, the pressing piece 123 rotates counterclockwise in FIG. 8 (clockwise in FIG. 9). Here, in order to clearly depict the configuration of the pressing piece 123, the axle 121 has been abbreviated in FIG. 8 and the axles 121 and 125 and lever 117 have been omitted.

Figure 13:
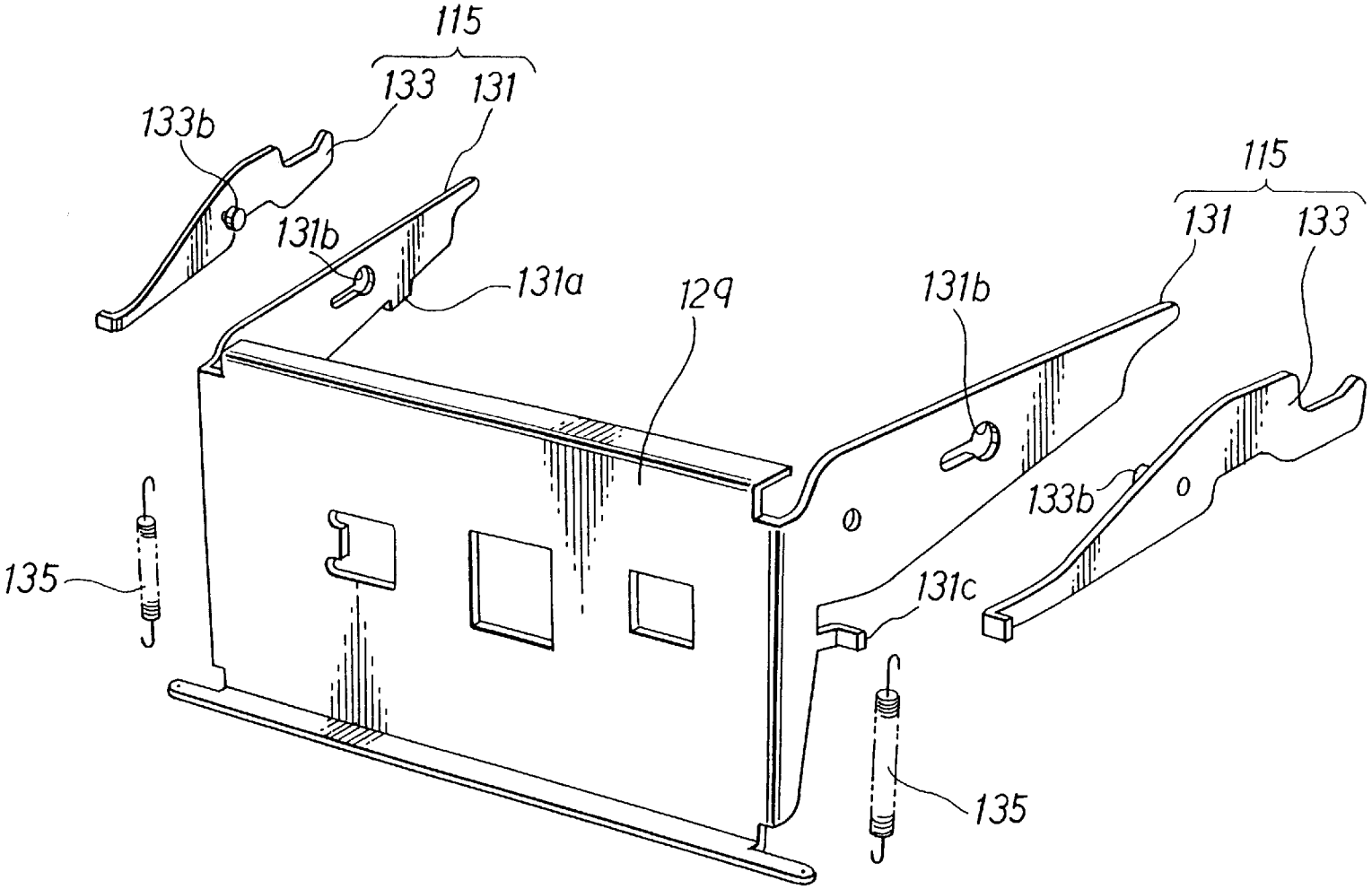
FIG. 13 is an exploded perspective view showing the configuration of an arm of the maintenance unit.

As shown in FIG. 13, an iron plate 129 is connected to the front end of paired arms 115. The distal end of the pressing piece 123 presses the iron plate 129 as it sways, as above. As shown in FIGS. 8, 9 and 13, each arm 115 includes an upper arm 131 pivoting about an axle 115*a,* and a lower arm 133 which is pivotally supported about a stepped, crimped pin 133*b* which is fitted into the small-diametric part of a keyhole 131 provided in the approximate middle of the upper arm 131. The front ends of the upper arms 131 are fixed to the left and right edges of the iron plate 129 or they may be formed from an metal sheet and bent by folding. A helical tension spring 135 is extended between the front end of the lower arm 133 and the lower end of the iron plate 129. This helical tension spring 135 urges the rear end of the lower arm 133 upwards. The front side lower edge of the lower arm 133 abuts a projection piece 131*c* formed by folding at the front side lower edge of the upper arm 131. In this state, the rear ends of the upper arm 131 and lower arm 133 are shaped so as to create a gap 115*b* which can have the pin 93*a* just fitted therein. The helical tension spring 135 also functions to keep the stepped, crimped pin 133*b* of the lower arm 133 from moving from the small-diametric side to the large diametric side within the keyhole 131*b* of the upper arm 131, thus maintaining the mated condition.

When the iron plate 129 is pushed by the pressing piece 123, the whole arms 115 pivot about respective axles 115*a* in a counterclockwise direction in FIG. 8, so that the pressing plate 89 is projected together with a stretch of paper 7. When the pressing plate 89 abuts the nozzle head 31 etc., with a stretch of paper 7 in between, the lower arms 133, whilst opposing the urging force of the helical tension springs 135, pivot about respective stepped, crimped pins 133*b* in a clockwise direction in FIG. 8, to thereby reduce the impact upon abutment. Further, if any part had some dimensional error or variation etc., due to manufacture or assembly, or in order to improve the print quality, the distance of the nozzle surface 36 from the platen had been modified depending upon the type of the print paper, it is possible to urge the pressing plate 89 uniformly against the nozzle surface 36. That is, the pressing plate 89 corresponds to the support element for the strip, the lever 117 corresponds to the movable element, and the helical tension spring 135 and the lower arm 133 correspond to the damper. Furthermore, when the pressing force from the pressing piece 123 is not active, the arms 115 are held at the down position by the action of a leaf spring 137 (FIG. 8).

Referring next to FIG. 9, the gear mechanism for driving the maintenance unit 100 will be described. A gear 141 provided at the front side of the maintenance unit 100, is disposed coaxially with an unillustrated conveying roller for conveying a recording sheet, and rotates as receiving the driving force from the conveying roller. A gear 142 meshing the gear 141 has an open-V shaped lever 142*a* which is pivotable coaxially therewith. Attached to one end of the lever 142*a* is a gear 143 meshing the gear 142, forming a so-called planetary gear mechanism. The other end of the lever 142*a* is arranged so as to be able to abut an abutment piece 131*a* formed in the lower side of the upper arm 131.

The gear 141 rotates clockwise during conveyance of a recording sheet, hence the gear 142 rotates counterclockwise while the gear 143 rotates clockwise. This causes the lever 142*a* to rotate counterclockwise, so that the gear 143 is kept from meshing an adjacent gear 144 which is integrally composed of two, large and small-diametric gear elements. The arrows shown in FIG. 9 indicate the movements of the gears 141 to 143 and the lever 142*a* in this state. The lever 142*a,* when it has swayed to the position shown in FIG. 9, will not move further due to the action of an unillustrated stopper. Accordingly, while the head 1 is forming an image on a sheet of recording paper as it being conveyed, no driving force is transmitted to the maintenance unit 100.

When the conveying roller turns in the reverse direction and hence the gear 141 is rotated counterclockwise, the lever 142*a* pivots clockwise. However, if the arms 115 are in a down position as shown by the solid line in FIG. 9, the other end of the lever 142*a* abuts the abutment piece 131*a* of the upper arm 131. Therefore, the gear 143 will not mesh with the gear 144. When the carriage 3 has been moved to the maintenance area by the motor 8, the lever 117 comes into contact with the rotational carriage and rotates as stated above so that the upper arms 131 are raised up to a position indicated by the two-dot chain line in FIG. 9. In this state, the conveying roller turns in the reverse direction, the lever 142*a* sways to a position depicted by the two-dot chain line in FIG. 9, and hence the gear 143 meshes the large-diametric element of the gear 144. Briefly, only when the carriage 3 has moved to the vicinity of the maintenance area and when the conveying roller turns in the reverse direction, the driving force will be transferred to the mechanism located after the gear 144.

Figure 10:
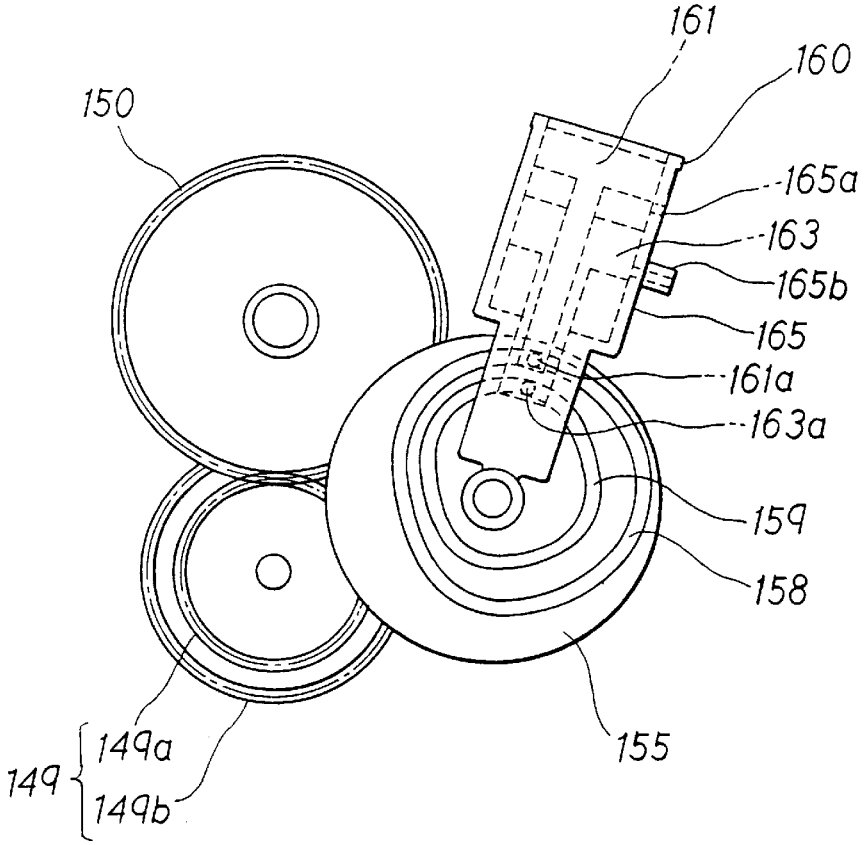
FIG. 10 is a right-side view showing the configuration in the vicinity of a pump for the maintenance unit.

The small-diametric element of the gear 144 meshes a gear 146 via a large-diametric gear 145. This gear 146 has an integrated structure having two, large and small gear elements. The gear 145 meshes the large-diametric element of the gear 146. The unillustrated small-diametric element of the gear 146 is configured to mesh the gear 91 which is exposed to the outside on the left side surface of the cassette 80, when the mounting of the cassette 80 is complete. The large-diametric element of the gear 144 meshes a gear 149 via gears 147 and 148. The gear 149 has two, large and small gear elements integrated therein as shown in FIG. 10. The small-diametric element designated at 149*a* is meshed with the large-diametric gear 150. This gear 150 comes into mesh with the gear 92 of the cassette 80 when the cassette 80 has been completely mounted (FIG. 9). Therefore, if the driving force is transmitted to the gear 144, the gears 91 and 92, and hence the fixed-rate feed roller 85 and winding shaft 87 (FIG. 6), which are integrated therewith, are caused to rotate, thus making it possible to convey the paper from the roll of paper 7. That is, the fixed-rate feed roller 85 and the winding shaft 87 correspond to the conveying device.

Further, the large-diametric element 149*b* of the gear 149 meshes a gear 157 which integrally rotates with a grooved cam 155. This grooved cam 155 has two grooves 158 and 159 which are approximately annular but eccentric, as shown in FIG. 10. These grooves 158 and 159 are to drive a pump 160. More specifically, the pump 160 comprises a piston 161 which will be slid by engagement of a pin 161*a* with the groove 158, and a piston 163 which will be slid by engagement of a pin 163*a* with the groove 159. A cylinder 165, into which the pistons 161 and 163 which are fitted has an intake port 165*a* and an exhaust port 165*a* formed therein.

Accordingly, as the grooved cam 155 rotates, the pistons 161 and 163 slidingly move out of phase from each other so that the volume of the space created between the two varies. Further, since in this case one of the ports, either the intake port 165*a* or exhaust port 165*b* is closed by piston 161 or 163, compressed air can be sent into air chamber 20 of the head 1 via the pipe 57 (FIG. 3) from exhaust port 165*b*. Therefore, when the conveying roller is reversed after the carriage 3 has been moved to the maintenance area, it is possible to implement the aforementioned purging whilst the roll of paper 7 is being conveyed.

Figure 11:
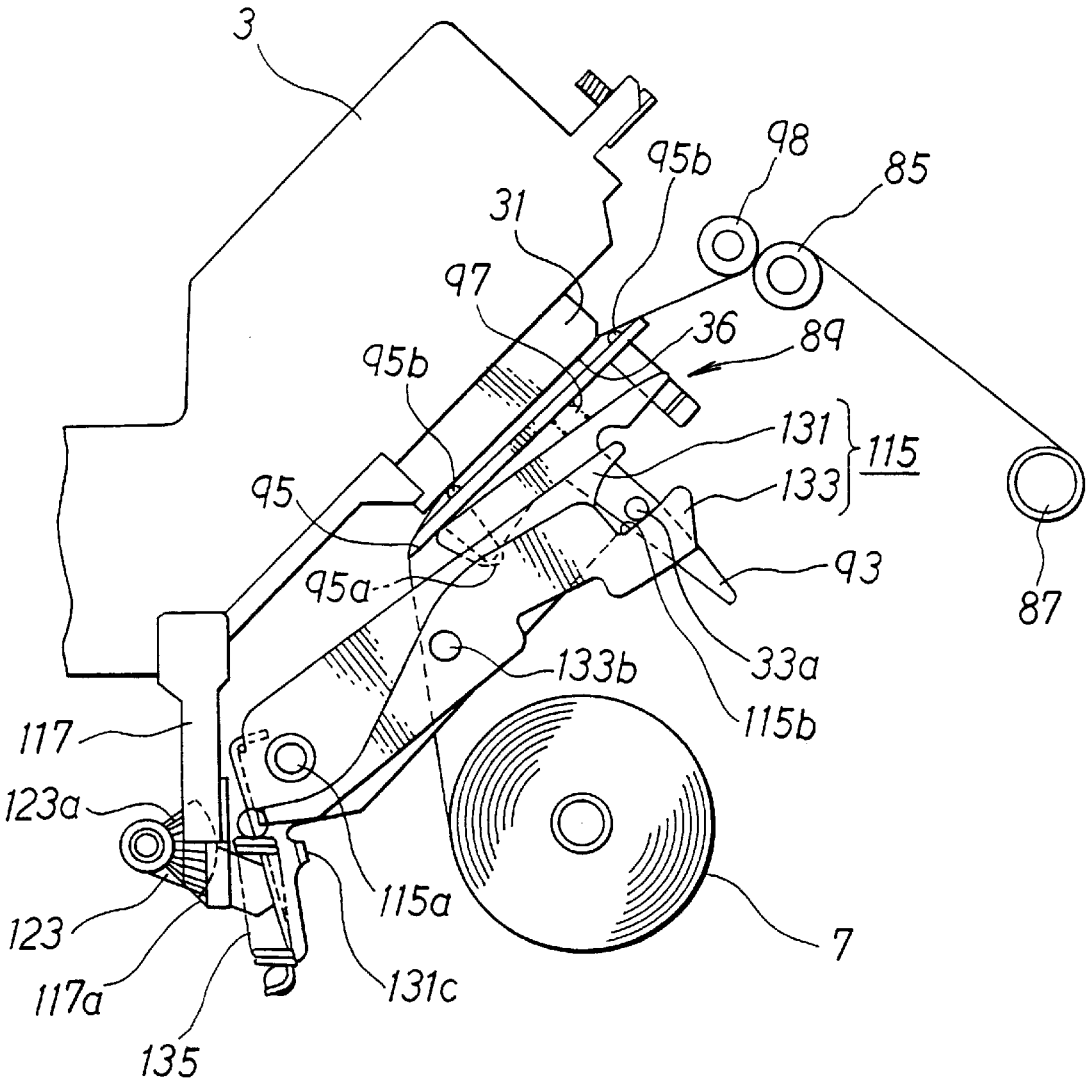
FIG. 11 is an illustrative view showing a wiping operation of the maintenance unit.
Figure 12:
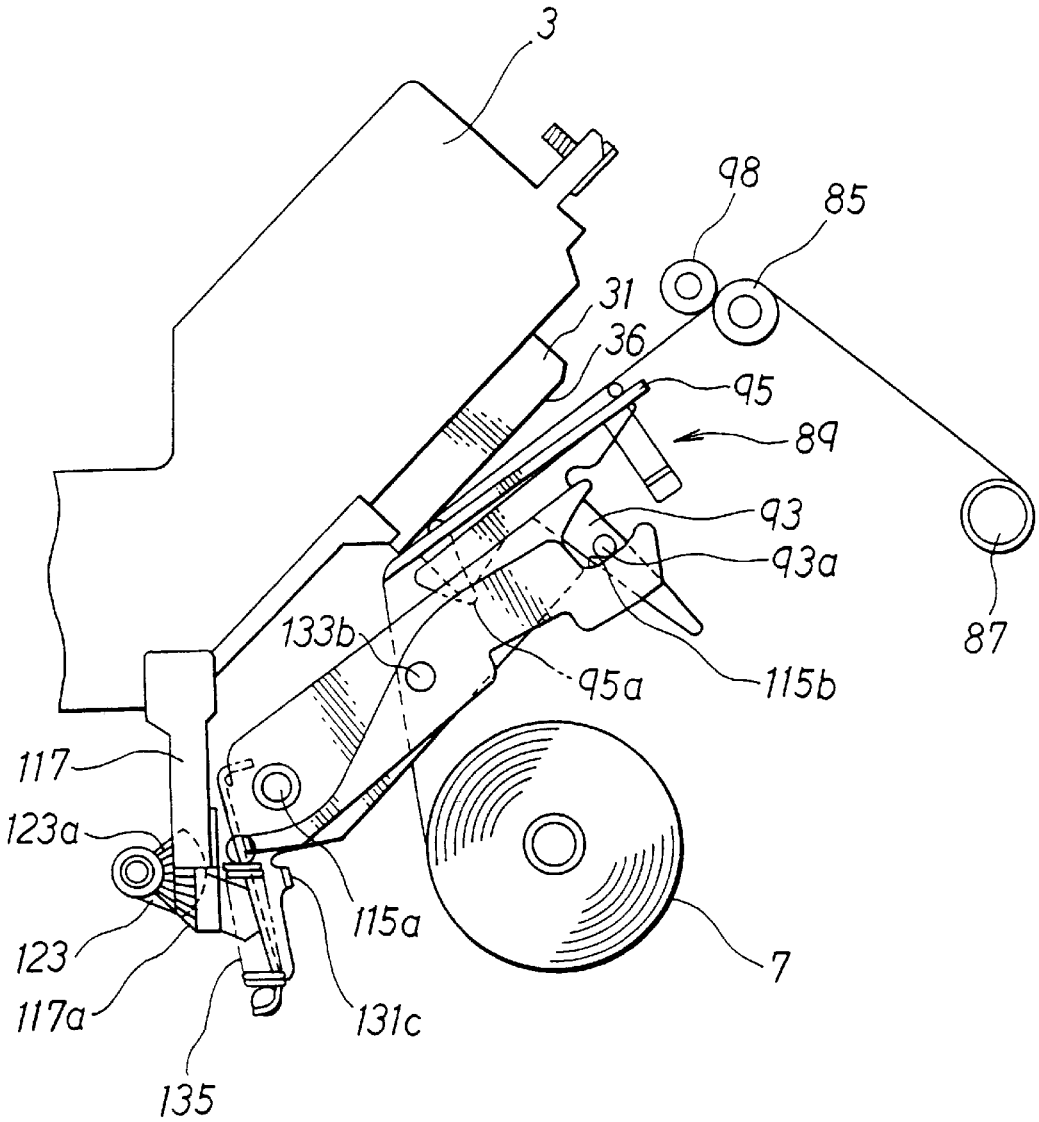
FIG. 12 is an illustrative view showing a purging operation of the maintenance unit.

Referring next to FIGS. 11 and 12, description will be made of how the pressing plate 89 and the roll of paper 7 operate when the carriage 3 moves. When the carriage 3 has moved to the maintenance area, the pressing plate 89 moves upward as stated above, and the plate 95 is pressed against the nozzle surface 36 of the nozzle head 31 with a stretch of paper 7 in between as shown in FIG. 11. Provided along the upper and lower edges on the surface of the plate 95 are a pair of ribs 95*b,* so that the strip of paper 7 is tensioned between the ribs 95*b*. Therefore, the strip of paper 7 can be tensioned with a remarkably good flatness over the plate 95 surface, hence is beneficially put in close contact with the nozzle surface 36. This operation facilities wiping of pollution around the nozzle surface 36.

Subsequently, when the conveying roller is reversed, the fixed-rate feed roller 85 and winding shaft 87 turn as stated above to convey the paper from the roll of paper 7. At this moment, the strip of paper 7 is tightly nipped between the nozzle head 31 and the lower edge of the plate 95 on the side on which the pins 95*a* are provided. Accordingly, the strip of paper 7 is tensioned between the nip and the fixed-rate feed roller 85. This tension causes the plate 95 to rotate downward (clockwise in FIG. 11) about the pins 95*a,* opposing the urging force from the compression coil spring 97. Therefore, a clearance can be formed between the nozzle surface 36 and the strip of paper 7, as shown in FIG. 12. As already stated above, purging is performed at this moment whilst the paper is conveyed from the roll of paper 7, thereby the formation of the clearance facilitates a smooth ejection of ink from the nozzle surface 36 during purging. Since the lower edge of the plate 95 is pressed against the nozzle head 31 nipping the strip of paper 7 therebetween, the ejected ink can be beneficially received by the roll of paper 7. Further, since the fixed-rate feed roller 85 and the grooved cam 155 are both linked with the gear 144, the amount of air sent from the pump 160 is in proportion to the conveyed length of the roll of paper 7. Accordingly, the ejected amount of ink during by purging is also in proportion to the conveyed length of the roll of paper 7. Thus, it is possible to receive the ejected ink in a markedly beneficial manner while also preventing the waste of the roll of paper 7.

Then, the carriage 3 is slightly moved to the left so as to create a gap between the passage hole 20*b* (FIG. 2) and the cap 55 (FIG. 3). In this situation, purging stops but the roll of paper 7 still remains able to be conveyed. If the roll of paper 7 is kept on being conveyed during this condition, an unused strip of paper 7 can be set over the surface of the plate 95. Thereafter, when the carriage 3 is moved further to the left to be set away from the lever 117 and is moved again to the maintenance area, the unused strip of paper 7 is pressed against the nozzle surface 36 as already stated with reference to FIG. 11. This operation facilitates wiping of ink left over the nozzle surface 36 after purging, to thereby complete the maintenance operation of the head 1.

Figure 15A:
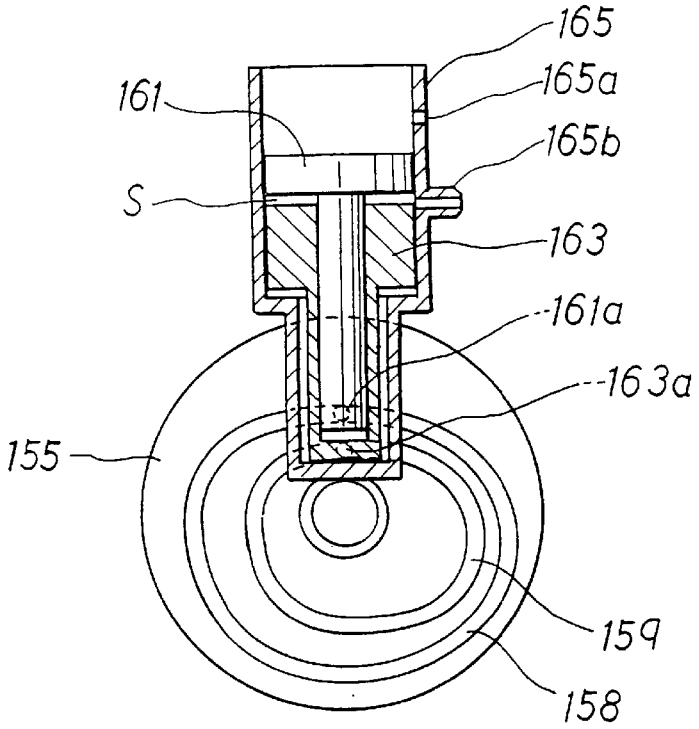
FIGS. 15A to 15D are illustrative views showing the operation of the pump for the maintenance unit.
Figure 15B:
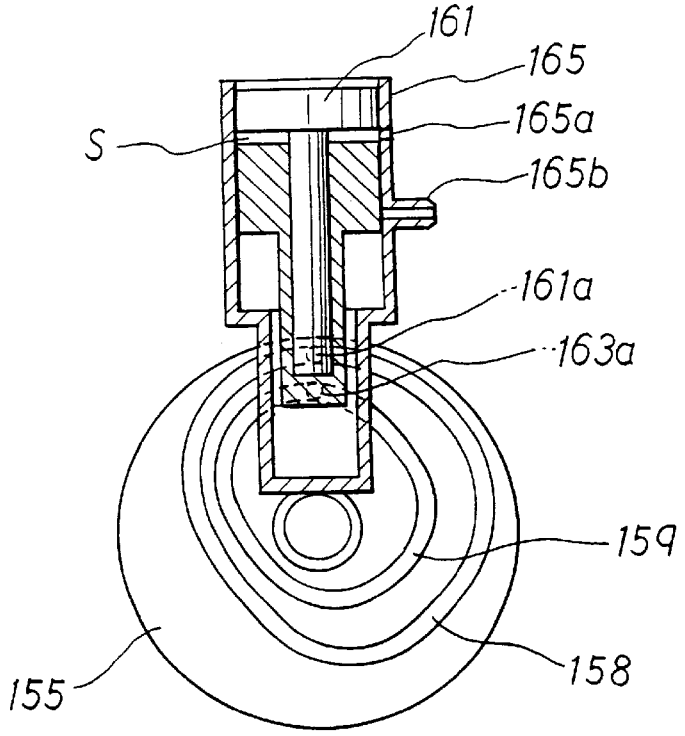
Figure 15C:
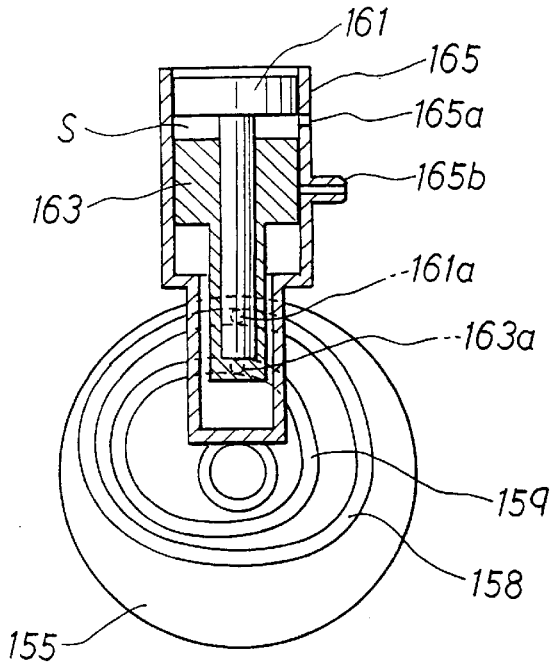
Figure 15D:
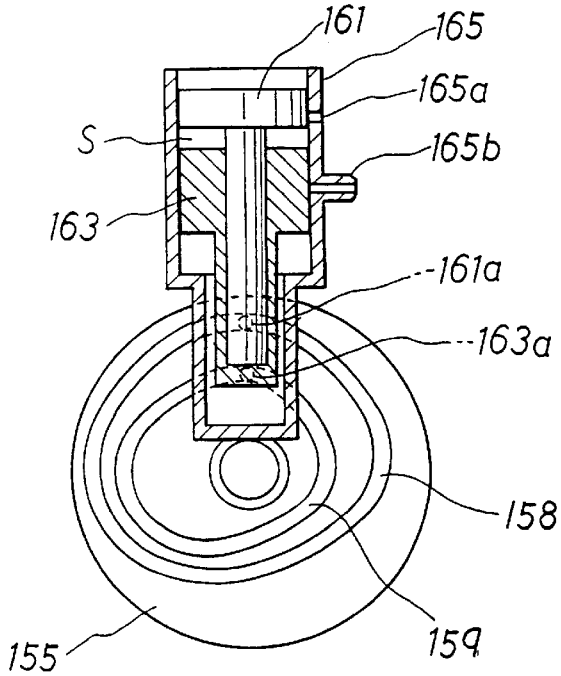

Now, the operation of the pump 160 will be described in detail with reference to FIGS. 15A to 15D. Here, FIGS. 15A to 15D are sectional views showing the movements of pistons 161 and 163 with the rotation of the grooved cam 155. Suppose that the state shown in FIG. 15A represents 0°, FIGS. 15B, 15C and 15D show the states where the grooved cam 155 is rotated to 120°, 180° and 210°, respectively, in the aforementioned rotational direction (counterclockwise in FIGS. 15A to 15D) therefrom.

FIG. 15A corresponds to a state where exhaust is complete; that is, a space S formed between the pistons 161 and 163 is very small while the space S opens to the exhaust port 165*b*. When the grooved cam 155 turns to the position shown in FIG. 15B and hence the pistons 161 and 163 rise with the movement, the space S opens to the intake port 165*a* whereby intake is ready and can start. Thereafter, with the piston 161 remaining at the same position, the piston 163 goes downward so as to enlarge the volume of the space S as shown in FIG. 15C. During this step, air is suctioned from the intake port 165*a*.

When the grooved cam 155 rotates more than 180°, the piston 161 also starts lowering. This movement causes the piston 161 to close the intake port 165*a,* then the space S is kept sealed and moved toward the intake port 165*b* without varying in its volume as shown in FIG. 15D. Since only the piston 161 moves down after the space S has become open to the exhaust port 165*b,* as shown in FIG. 15A, the air within the space S is discharged through exhaust port 165*b*.

In this way, in the present ink-jet printer, the pump 160 is driven by the same driving source (from the aforementioned conveying roller integrally rotating with the gear 141, that is, from an unillustrated motor for driving the conveying roller) as that for the mechanism for conveying the roll of paper 7. Further, this driving source is also shared with that for the conveying roller. Accordingly, the maintenance unit 100 can be configured with a very simplified design, without any its own driving source.

As stated above, in this ink-jet printer, the paper is conveyed from the roll of paper 7 by the fixed-rate feed roller 85 and the winding shaft 87. As the wound roll of paper 7 on the winding shaft 87 increases in radius, the conveyed length per revolution becomes greater. Accordingly, if the winding shaft 87 is rotated at a fixed speed during purging, the winding speed of the roll of paper 7 becomes gradually greater, so the wastage of paper 7 becomes a maximum at the end of the roll. Particularly, in the ink-jet printer, since the winding shaft 87 and pump 160 are driven by the common driving source, if the windings shaft 87 and grooved cam 155 are rotated at a fixed rate, the conveyed length of the paper 7 from the roll only will increase even though the ejected amount of ink during purging is fixed.

To overcome this problem, this ink-jet printer uses the following two techniques so that the paper 7 will be always conveyed at a constant rate if the grooved cam 155 rotates at a fixed speed. The first method makes use of the aforementioned fixed-rate feed roller 85. The length to be conveyed per revolution of fixed-rate feed roller 85 is always fixed. To achieve this, while the nip roller 98 is pressed against the fixed-rate feed roller 85 to firmly hold the strip of paper 7 therebetween, the fixed-rate feed roller 85 is rotated at a fixed speed to thereby convey the paper 7 at a fixed rate from the roll.

Figure 16:
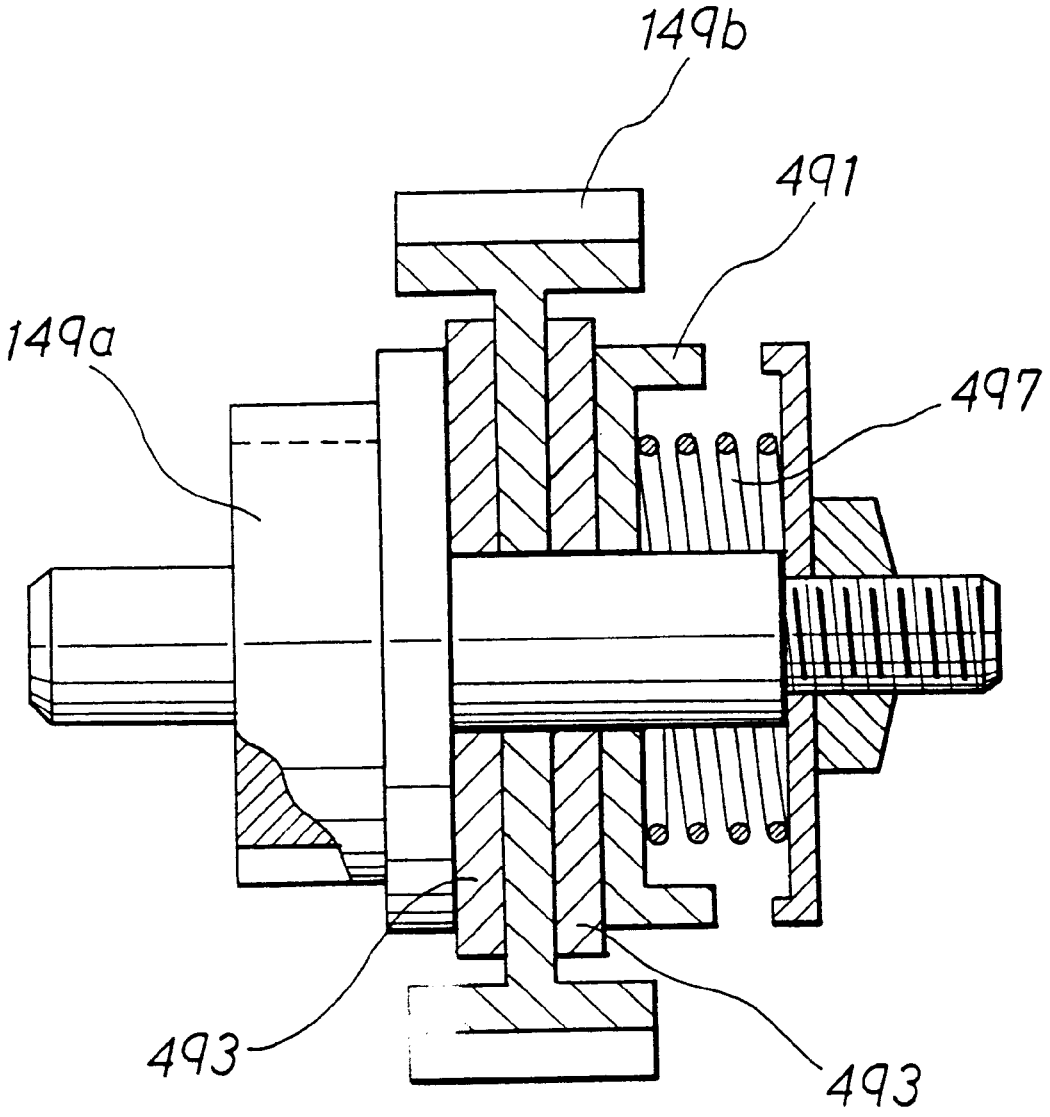
FIG. 16 is an illustrative view showing the configuration of a slip clutch of the maintenance unit.

As a second method, a so-called slip clutch (also called a torque limiter) is provided for the driving force transmission system to the winding shaft 87. This slip clutch is used to retard the rotational speed of the winding shaft 87 by causing slip with respect to the driving force transmission system when the length of the paper 7 conveyed by the winding shaft 87 increases. Illustratively, the small-diametric element 149*a* of the gear 149 which drives the winding shaft 87 via the gear 150, is configured as follows. As shown in FIG. 16, the small-diametric element 149*a,* in cooperation with a disc 491 which is integrally rotatable therewith, but axially movable with respect thereto, holds the large diametric element 149*b* therebetween via a pair of felt discs 493 interposed on both sides thereof so that the large-diametric element 149*b* is rotatable relative to the other components, while a compression coil spring 497 is disposed so as to press and hold the element 149*b*. Accordingly, as the radius of the wound roll of paper 7 on the winding shaft 87 increases, the strip of paper 7 is tensioned between the fixed-rate feed roller 85 and the peripheral side of the winding shaft 87, this tension produces a frictional force and causes slippage either between the small-diametric element 149*a* and the felt disc 493, or the felt disc 493 and the large-diametric element 149*b*. As a result, the rotational speed of the winding shaft 87 can be adjusted to the rotational speed associated with the conveyed length of the fixed-rate feed roller 85, thus making it possible to convey the strip of paper 7 at a fixed rate.

As has been described above, in the ink-jet printer, the force from the motor 8 to move the carriage 3 is utilized to move a stretch of paper 7 toward the nozzle surface 36. Accordingly, there is no need to provide a dedicated actuator for moving the paper 7 toward the nozzle surface 36, thus making it possible to achieve a simplified configuration of the maintenance unit 100. Hence, the manufacturing cost of the ink-jet printer can also be reduced.

In the maintenance unit 100, impacts arising when the pressing plate 89 abuts the nozzle head 31 are damped by the helical tension spring 135 and the lower arm 133. Accordingly, the nozzle 31 can be well protected from the impacts and it is also possible to successfully absorb the error and fluctuations which occurred when the arm 115 and pressing plate 89 etc. were manufactured and/or assembled. That is, even if these elements involve such error and fluctuations, it is possible to press the stretch of paper 7 against the nozzle head 31 at approximately constant pressure. Further, when the distance of the nozzle surface 36 from the platen is changed in conformity with the type of print paper in order to improve the quality of the print, it is possible to uniformly press the pressing plate 89 against the nozzle surface 36. Hence, it is possible to reliably effect a markedly reliable maintenance operation as well as to further enhance the durability of the head 1 and the productivity of the ink-jet printer.

Further, purging can be performed whilst the paper 7 is conveyed from the roll as stated above, or the paper can be delivered from the roll of paper 7 so that the unused part of paper may be set over the pressing plate 89 to thereby wipe ink. Thus, the above maintenance operation makes it possible to continuously keep the head 1 clean. In the present ink-jet printer, it is possible to keep the image very clear.

The conveyed length of the roll of paper 7 is maintained at a constant in conformity with the rotational rate of the grooved cam 155, and the conveyance of the roll of paper 7 is performed in time with the drive of the grooved cam 155. Therefore, in the maintenance unit 100, it is possible to correctly synchronize the conveyance of the roll of paper 7 with the drive of the pump 160 without providing any special setup. Accordingly, if the amount of pressure from the pump 160 is varied by changing the rotational rate of the grooved cam 155, the roll of paper 7 can be conveyed at a rate corresponding to the amount of pressure. That is, if the amount of pressure varies, the amount of ink ejected from the nozzle surface 36 also varies, resulting in the length of the roll of paper 7 required for receiving the ink to vary. In the maintenance unit 100, since the conveyed length of the roll of paper 7 is synchronized as stated above, it is possible to realize a further enhanced ink reception, without needing a complex configuration.

In the above embodiment, when the carriage 3 has not moved to the maintenance area, the lever 142*a* abuts the abutment piece 131*a,* so that the driving force will not be transmitted to either the pump 160, fixed-rate feed roller 85 or the winding shaft 87. That is, while the head does not reside at the predetermined position where the maintenance is to be implemented, a prohibiting means for prohibiting the transmission of the driving force to the pump and the conveying means is further provided. Therefore, it is possible to prevent the maintenance unit 100 and thereabouts from being polluted by a mal-operation of purging before the carriage 3 has moved to the maintenance area, and/or prevent the roll of paper 7 from being wasted by conveyance of the roll of paper 7 whilst the paper 7 has not been put in contact with the nozzle head 31.

The present invention should not be limited by the above embodiments, and can be embodied in a variety of forms without departing from the range of the invention as hereinafter claimed. The strip may be, for example, felt etc., other than rolls of paper 7, and can be used for maintenance applications other than for reception of ink and wiping of a nozzle surface. Here, it should be noted that wiping of a nozzle surface includes: frictional rubbing with the strip whilst it is abutted against the nozzle surface; and also mere abutment of the strip against the nozzle surface. In the above embodiment, while the strip of paper 7 is abutted against the nozzle surface 36 to perform wiping, it is also possible to frictionally move the nozzle surface 36 relatively with the strip of paper 7 abutted thereto, if the following configuration is adopted. That is, the lever 117 is configured so that when the lever 117 rotates to a position shown by the two-dot chain line in FIG. 7, the distal end of the lever 117 will be abutted against the undersurface of the carriage 3 and held at that position. This configuration enables the carriage to move left and right with the strip of paper 7 abutted against the nozzle surface 36 to thereby rub the nozzle surface 36 with the strip of paper 7. As for the damper, other than, or in addition to, the above configuration comprised of a helical tension spring 135 and a lower arm 133, an elastic material, e.g., sponge, applied to the surface of the pressing plate 89 may be used. This elastic material is preferably composed of a heat-resisting material because the head will be heated to a relatively high temperature.

Further, the pump may be a type which sucks the ink from the nozzle surface side to thereby clean the ink ejection path. However, in this case, it difficult to perform suctioning with the maintenance element being abutted against the head. Therefore, in order to use a common driving source, a planetary gear mechanism etc., may be used to selectively transmit the driving force to the conveyer or to the pump. Alternatively, it is also possible to provide a configuration in which one nozzle surface adjoining to another may be suctioned while the maintenance element may be abutted against the other nozzle surface. In the latter case, the conveyer and the pump can be driven simultaneously.

In the above embodiment in accordance with the first aspect of the invention, in order to make use of the rotational force (moving force) of the lever 117 (the moving element) rotated by the contact with the carriage when the carriage has moved to the maintenance area, as the driving force to cause the pressing plate 89 to move toward the head, bevel gears 117*a* and 123*a,* the pressing pieces 123, iron plate 129 and arm 115 are used. However, these driving force transmission elements are for illustrative purposes only, and any power transmission elements may of course be used. That is, any and all elements and arrangements which may occur to those skilled in the art, as long as they can transform the moving force of the moving element which is caused to move by the carriage into the driving force for causing the pressing plate as the support element to move toward the head, or can transmit the same force to cause the pressing plate to move toward the head, should be considered to be within the scope of the invention.

What is claimed is:

1. An ink-jet recording apparatus comprising:

a recording head having a nozzle for ejecting ink;

a carriage for conveying the recording head and moving across the width of the recording area opposing a recording medium and an additional area outside thereof;

a moving element, disposed within the area outside the recording area, which moves by being put in contact with the carriage or the head when the carriage has moved to the outside area;

a strip disposed within the outside area for cleaning the recording head with a surface thereof; and a support element for supporting the rearside of the strip and moving toward the recording head to press the strip against the nozzle of the recording head, wherein the support element is caused to move toward the head by a driving force generated by the movement of the moving element, to thereby press the strip against the head.

2. The ink-jet recording apparatus according to claim 1, further comprising a transmission element for transmitting the force generated by the movement of the moving element to the support element.

3. The ink-jet recording apparatus according to claim 1, wherein the moving element is a rotational lever which is rotated by being put into contact with the carriage or the head when the carriage has moved to the area outside the recording area.

4. The ink-jet recording apparatus according to claim 3, further comprising:

a first gear connected to the rotational lever;

a second gear meshing with the first gear;

a rotational element connected to the second gear; and a pivot arm urged by the rotational element so as to pivot, the pivot arm being engaged with the support element, thereby transmitting the rotational force of the rotational lever to the support element so that the support element will move toward the head.

5. The ink-jet recording apparatus according to claim 4, wherein the pivot arm comprises:

an upper arm;

a lower arm;

a rotational shaft for rotatably supporting the lower arm with respect to the upper arm; and a spring urging the lower arm in a predetermined rotational direction with respect to the upper arm, the upper arm has a pivot axle for the pivot arm, the lower arm is engaged with the support element, and the lower arm rotates with respect to the upper arm, opposing the urging force of the spring, when the support element has pressed the strip against the head.

6. The ink-jet recording apparatus according to claim 1, further comprising: a damper for damping the impacts when the support element has presses the strip against the head.

7. The ink-jet recording apparatus according to claim 1, wherein an elastic element is provided on the support surface of the support element.

8. The ink-jet recording apparatus according to claim 1, wherein at least two ribs are formed on a support surface of the support element and a part of the strip is stretched between the ribs.

9. The ink-jet recording apparatus according to claim 1, further comprising: a conveyer for conveying the strip relative to the head to refresh the part of the strip opposing the head.

10. The ink-jet recording apparatus according to claim 9, further comprising:

a pump which is coupled to the recording head, and applies a pressure to the interior of the recording head to purge ink channels and the nozzle; and a driving motor with a conveying roller for conveying the recording media, wherein the pump and the conveyer are also driven by a driving force from the driving motor.

11. An ink-jet recording apparatus comprising:

a recording head having ink channels formed therein and a nozzle for ejecting ink;

a pump which applies a pressure to the interior of the recording head to purge the ink channels and the nozzle;

a strip used for cleaning the recording head;

a conveyer for conveying the strip to thereby refresh a part of the strip opposing the nozzle; and a common driving source for driving the pump and the conveyer.

12. The ink-jet recording apparatus according to claim 11, further comprising: a carriage for conveying the recording head, capable of moving across the width of the recording area opposing a recording medium and an additional area outside thereof where the strip and the conveyer are disposed.

13. The ink-jet recording apparatus according to claim 12, wherein the recording head is provided with a hole which communicates with the ink channels and is connected to the pump.

14. The ink-jet recording apparatus according to claim 13, wherein when the carriage has moved to the area outside the recording area, the hole is covered by a cap communicating with the pump so that pressurized air is supplied from the pump through the cap into the interior of the recording head, to thereby effect the purging.

15. The ink-jet recording apparatus according to claim 12, further comprising:

a conveying roller for conveying the recording medium; and a motor for rotating the conveying roller, wherein the motor is a common driving source for driving the pump and the conveyer.

16. The ink-jet recording apparatus according to claim 15, further comprising:

a planetary gear mechanism which can transmit the driving force from the motor to the pump and the conveyer only when the conveying roller is reversed.

17. The ink-jet recording apparatus according to claim 16, further comprising:

a rotational lever which is rotated by being put in contact with the carriage or the head when the carriage has moved to the area outside the recording area;

a pivot arm pivoting from a first position to a second position with the rotation of the rotational lever, wherein the planetary gear mechanism has a sun gear, a planetary gear and a planetary arm supporting the planetary gear, and when the pivot arm is positioned at the first position, the pivot arm interferes with the rotation of the planetary arm even if the conveying roller is reversed, whereas when the pivot arm is positioned at the second position, the planetary gear mechanism transmits the driving force of the motor to the pump and the conveyer in the case where the conveying roller is reversed.

18. The ink-jet recording apparatus according to claim 11, wherein the pump comprises:

a pair of pistons each having an individual piston pin;

a single cylinder, having an intake port and exhaust port, inside which the two pistons move; and a cam having a pair of eccentric annular grooves which are engaged with the two piston pins, respectively.

19. The ink-jet recording apparatus according to claim 11, wherein the conveyer comprises:

a feed roller for delivering the strip; and a winding shaft for taking up the strip.

20. The ink-jet recording apparatus according to claim 19, wherein the feed roller is a fixed-rate feed roller.

21. The ink-jet recording apparatus according to claim 19, wherein the winding shaft has a slip clutch.

22. The ink-jet recording apparatus according to claim 11, wherein the strip is accommodated in a cassette casing which is removably attached to the recording apparatus.

23. The ink-jet recording apparatus according to claim 11, wherein the driving source drives the pump and the conveyer simultaneously.

24. The ink-jet recording apparat us according to claim 11, which is a hot-melt type ink-jet printer.

25. A maintenance device for an ink-jet recording apparatus having a recording head having ink channels formed therein and a nozzle for ejecting ink, comprising:

a pump which is connected to the recording head and applies a pressure to the interior of the recording head to purge the ink channels and the nozzle;

a strip used for cleaning the recording head;

a conveyer for conveying the strip to thereby refresh a part of the strip opposing the nozzle; and a common driving source for driving the pump and the conveyer.

26. The maintenance device according to claim 25, wherein the pump applies a positive pressure inside the recording head.

27. The maintenance device according to claim 25, wherein the pump comprises:

a pair of pistons each having an individual piston pin;

a single cylinder, having an intake port and exhaust port, inside which the two pistons move; and a cam having a pair of eccentric annular grooves which are engaged with the two piston pins, respectively.

28. The maintenance device according to claim 25, wherein the conveyer comprises:

a feed roller for delivering the strip; and a winding shaft for taking up the strip.

29. The maintenance device according to claim 25, wherein the winding shaft has a slip clutch.

30. The maintenance device according to claim 25, wherein the feed roller is a fixed-rate feed roller.

* * * * *